US007366439B2

(12) United States Patent
Anan et al.

(10) Patent No.: US 7,366,439 B2
(45) Date of Patent: Apr. 29, 2008

(54) METHOD OF REMANUFACTURING CARTRIDGE AND REMANUFACTURED CARTRIDGE

(75) Inventors: Osamu Anan, Susono (JP); Akira Suzuki, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/150,114

(22) Filed: Jun. 13, 2005

(65) Prior Publication Data

US 2005/0276628 A1 Dec. 15, 2005

(30) Foreign Application Priority Data

Jun. 14, 2004 (JP) ..... 2004-175099

(51) Int. Cl.
*G03G 15/00* (2006.01)

(52) U.S. Cl. ..... 399/109

(58) Field of Classification Search ..... 399/109
See application file for complete search history.

(56) References Cited

U.S. PATENT DOCUMENTS

| | | | | |
|---|---|---|---|---|
| 3,618,826 | A * | 11/1971 | Kanagas et al. | 222/166 |
| 4,181,549 | A * | 1/1980 | McPhee | 156/146 |
| 5,966,567 | A | 10/1999 | Matsuzaki et al. | 399/111 |
| 6,144,815 | A | 11/2000 | Chadani et al. | 399/27 |
| 6,154,623 | A | 11/2000 | Suzuki et al. | 399/111 |
| 6,157,796 | A * | 12/2000 | Fujiwara | 399/106 |
| 6,173,140 | B1 | 1/2001 | Suzuki et al. | 399/113 |
| 6,173,145 | B1 | 1/2001 | Chadani et al. | 399/265 |
| 6,205,305 | B1 | 3/2001 | Suzuki et al. | 399/106 |
| 6,219,504 | B1 | 4/2001 | Matsuzaki et al. | 399/92 |
| 6,246,849 | B1 | 6/2001 | Yokoyama et al. | 399/117 |
| 6,246,853 | B1 | 6/2001 | Suzuki et al. | 399/262 |
| 6,282,389 | B1 | 8/2001 | Matsuzaki et al. | 399/111 |
| 6,415,121 | B1 | 7/2002 | Suzuki et al. | 399/111 |
| 6,549,736 | B2 | 4/2003 | Miyabe et al. | 399/111 |
| 6,654,578 | B2 | 11/2003 | Suzuki et al. | 399/111 |
| 6,771,920 | B2 | 8/2004 | Abe et al. | 399/176 |
| 6,795,666 | B2 | 9/2004 | Miyabe et al. | 399/109 |
| 6,868,243 | B2 | 3/2005 | Watanabe et al. | 399/113 |
| 6,931,226 | B2 | 8/2005 | Chadani et al. | 399/109 |
| 6,934,485 | B2 | 8/2005 | Miyabe et al. | 399/90 |
| 7,099,607 | B2 | 8/2006 | Suzuki et al. | 399/111 |
| 2001/0036989 | A1 * | 11/2001 | Rohn et al. | 524/364 |
| 2002/0159787 | A1 | 10/2002 | Chadani et al. | 399/109 |
| 2005/0056624 | A1 * | 3/2005 | Wazana et al. | 219/121.67 |
| 2005/0276628 | A1 | 12/2005 | Anan et al. | 399/109 |
| 2006/0120754 | A1 | 6/2006 | Suzuki et al. | 399/111 |

FOREIGN PATENT DOCUMENTS

| | | |
|---|---|---|
| JP | 05-263065 A | 10/1993 |
| JP | 10-020744 | 1/1998 |
| JP | 2002-328579 A | 11/2002 |

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

A method of remanufacturing a cartridge detachably mountable in an electrophotographic image-forming apparatus body and composed of styrene-based resin compositions at least in part, characterized by including the steps of: (1) dividing the cartridge into at least two parts; and (2) bonding at least one of the divided parts with another one of the divided parts and/or a component other than the divided parts by use of a terpene solvent.

14 Claims, 24 Drawing Sheets

METHOD OF REMANUFACTURING CARTRIDGE AND REMANUFACTURED CARTRIDGE

BACKGROUND OF THE INVENTION

1. Field of the Invention

The present invention relates to a cartridge detachably mountable in an electrophotographic image-forming apparatus, in particular a process cartridge. The electrophotographic image-forming apparatus is an apparatus that forms an image on a recording medium using an electrophotographic image-forming system. Examples of the electrophotographic image-forming apparatus include an electrophotographic copying machine, an electrophotographic printer (e.g., a laser beam printer and an LED printer), a facsimile machine, and a word processor. The process cartridge is a cartridge detachably mountable in a main body of the image-forming apparatus, into which charging means, developing means, cleaning means, and so on, serving as means of an electrophotographic image-forming process (hereinafter, referred to as a "process means") are integrated with an electrophotographic photosensitive drum.

2. Description of the Related Art

Heretofore, in a conventional electrophotographic image-forming apparatus using an electrophotographic image-forming process, a "process cartridge system" is used in which an electrophotographic photosensitive drum (hereinafter, referred to as a photosensitive drum) and process means acting on the photosensitive drum are integrated into a process cartridge that is detachably mountable in the main body of the electrophotographic image-forming apparatus. Examples of the process cartridge include those integrating therein a photosensitive drum and at least one of charging means, developing means, and cleaning means, particularly at least developing means.

According to the process cartridge system, the maintenance of the apparatus can be carried out by the user himself/herself without an aid of a serviceman, thereby being capable of remarkably improving operability thereof. Therefore, the process cartridge system has widely been used in the electrophotographic image-forming apparatuses.

An example of general process cartridges will be described with reference to FIGS. 23 and 24. A process cartridge shown in FIG. 23 is composed of three frame members: a cleaning frame member 113 integrally supporting a photosensitive drum 107, a charging roller (not shown), and a cleaning blade (not shown); a developing frame member (not shown) integrally supporting a developing roller (not shown) and a developing blade (not shown); and a developer-accommodating frame member (hereinafter, referred to as a"toner frame member") 111 accommodating toner therein. The process cartridge is further constructed of side covers 190 and 191 covering a drive gear line (not shown) and so on, on the side surfaces of both or either of the developing frame member and(or) the toner frame member. It is noted that reference numerals 136 and 138 represent a drum flange and a drum bearing, respectively.

Means of fixing frame members and components, which is generally used includes fastening with screws (bonding in portions X and an area d in FIGS. 23 and 24) and thermal caulking, in addition to resin bonding (fixation by injection of a molten resin), hot-melts, ultrasonic welding (see e.g., JP 10-20744 A).

Such a process cartridge is one using a developer to form an image on a recording medium. Therefore, a developer is consumed as images are formed. The process cartridge loses value in use at the time when a developer has been consumed until the image-forming apparatus could not form an image having a quality that satisfies a user of the image-forming apparatus.

The related art propose remanufacturing techniques (recycling techniques) for putting, into commercial production again, process cartridges whose developer has been consumed and which have lost value in use (see e.g., JP 2002-328579 A).

However, the related art presents problems described below. For putting used process cartridges into commercial production again, components and frame members that have been consumed or broken are required to be replaced. For replacing components and frame members, each component and frame member need to be separated from fixing means and bonding means. In the case of fixation and bonding with screws, components and frame members may easily be removed, refixed, and rebonded. However, easy removal, refixation, and rebonding can not be performed in a site where fixing means such as resin bonding or welding is used. Therefore, in order to replace components and frame members in such a site, a rebonding method has been used, in which a junction or its surroundings is(are) broken and a component or a frame member is replaced, followed by refixation and rebonding by applying an adhesive, a hot melt, or the like, once again. However, fixing means requiring such a rebonding method is less than sufficient from the viewpoint of material recycling and environment. For example, a bonding method employing materials such as adhesives and hot melts different from materials used in frame members (styrene-based resin compositions including HIPS and other resin compositions) often causes a reduction in quality, such as a reduction in the mechanical properties and flame resistance of the frame members and components as recycled materials (materials to be remanufactured). Moreover, a bonding method employing a base material for adhesion having a thickness such as a hot melt is less than sufficient in terms of positioning accuracy and bonding strength among components.

By the way, terpene compounds have been known to be main ingredients of essential oils obtained by the steam distillation of mainly plants and to be generally used as flavors.

On the other hand, the uses of the terpene compounds other than the foregoing have also been known. For example, d-limonene, which is monoterpene, has a molecular structure greatly similar to that of styrene and a property of dissolving polystyrene even at normal temperature, and as such has been used as a constrictor for styrofoams (see e.g., JP 05-263065 A).

SUMMARY OF THE INVENTION

An object of the present invention is to provide a method of remanufacturing a cartridge that can be remanufactured for recycling, is environmentally sound, and can easily be reworked, that is, can be reassembled after a site fixed by resin bonding, welding, or the like is removed, disassembled, and repaired, when defective components and so on are found after assembly.

Another object of the present invention is to provide a method of remanufacturing a cartridge capable of providing a remanufactured cartridge with high positioning accuracy of components and high rigidity.

The present invention provides a method of remanufacturing a cartridge detachably mountable in an electrophotographic image-forming apparatus body and composed of styrene-based resin compositions at least in part, characterized by including the steps of:

(1) dividing the cartridge into at least two parts; and (2) bonding at least one of the divided parts with another one of the divided parts and/or a component other than the divided parts by use of a terpene solvent. The component other than the divided parts is a component used for forming the cartridge such as an alternative component used when the divided parts can not be reused.

In the method of remanufacturing a cartridge of the present invention described above, the step of dividing the cartridge preferably includes dividing the cartridge in-a portion composed of the styrene-based resin compositions.

Alternatively, in the present invention, it is preferable that at least one of the styrene-based resin compositions which exist in a portion to be divided include 100 parts by weight of a rubber-modified styrene-based resin, 4 to 13 parts by weight of a flame retardant, and 0 to 5 parts by weight of a flame retardant.

In the present invention, it is preferable that the terpene solvent be d-limonene. In this case, it is preferable that at least one of the styrene-based resin compositions which exist in a portion to be divided be a mixture of a styrene-based resin and a rubber-like polymer, and it is further preferable that the rubber-like polymer be a particle having an average particle diameter of 0.5 to 3.0 μm. It is particularly preferable that the rubber-like polymer be a polymer selected from the group consisting of polybutadiene, a styrene-butadiene copolymer, polyisoprene, a butadiene-isoprene copolymer, a natural rubber, and an ethylene-propylene copolymer.

In the present invention, it is preferred that a capillary phenomenon be used to supply a terpene solvent to portions to be bonded.

In the present invention, at least one of portions and of components to be bonded together is provided with a concave portion, a slit, or a chamfered portion that communicates with an inlet for injecting the terpene solvent and forms a flow path for supplying the terpene solvent to sites to be bonded.

It is preferable that the flow path have a cross sectional area of 0.01 to 4.0 $mm^2$.

A remanufacturing method of the present invention preferably includes the step of cleaning surfaces to be bonded before the terpene solvent is applied.

The present invention provides are manufactured cartridge that is remanufactured by using at least one of the methods of remanufacturing a cartridge described above.

As described above, the invention according to the present application is a method of remanufacturing a cartridge that is environmentally sound and can be easily reworked and remanufactured, the method being capable of providing a remanufactured cartridge with high positioning accuracy of components and high rigidity.

DETAILED DESCRIPTION OF THE PREFERRED EMBODIMENT

Hereinafter, an embodiment of the present invention will be described in detail with reference to drawings.

In the following description, the longitudinal axis of an image bearing member such as an electrophotographic photosensitive drum (hereinafter, referred to as a "photosensitive drum") and the longitudinal axis of a process cartridge perpendicularly intersect an axis in the direction that conveys a recoding medium.

[Description of Process Cartridge and Electrophotographic Image-Forming Apparatus Body]

Figure 1:
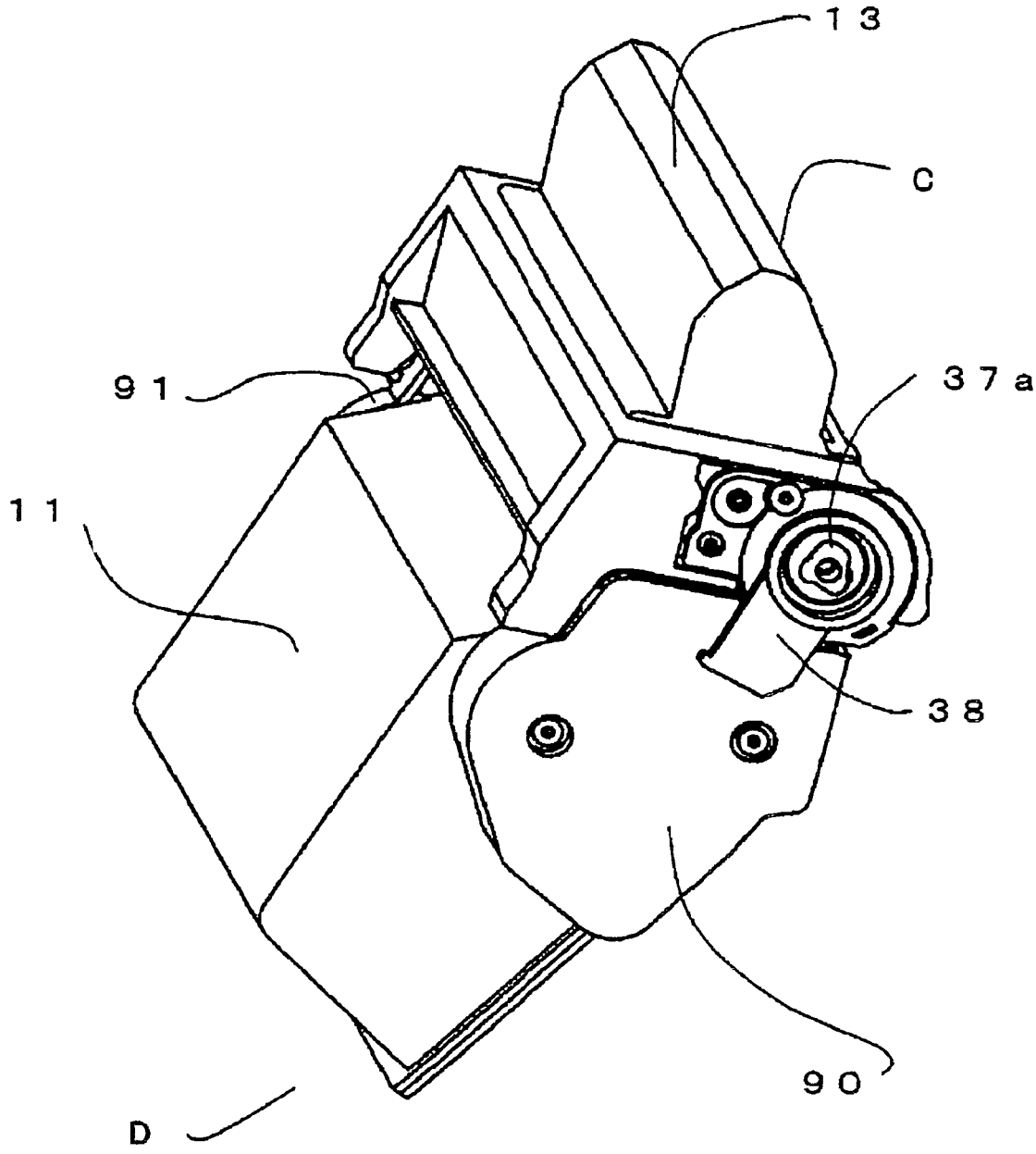
FIG. 1 is a perspective view of a process cartridge according to an embodiment of the present invention.
Figure 2:
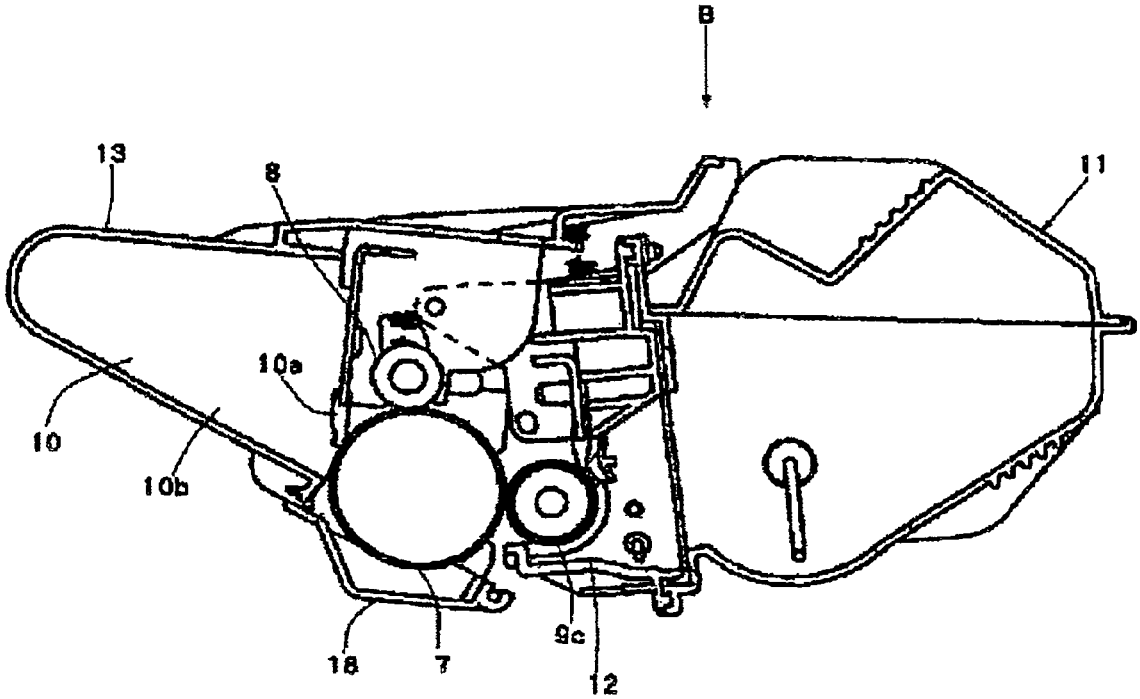
FIG. 2 is a schematic main sectional view of the process cartridge according to the embodiment of the present invention.
Figure 3:
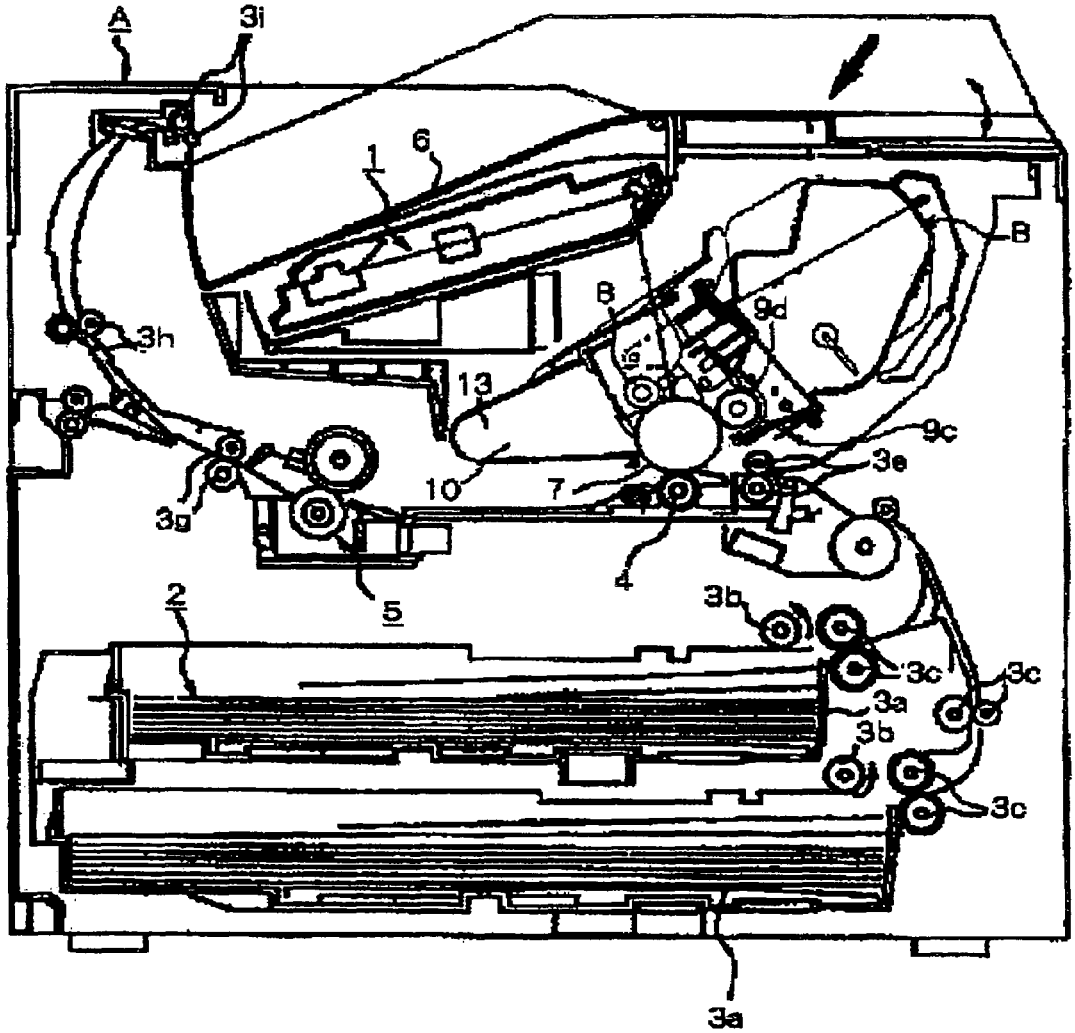
FIG. 3 is a schematic main sectional view of an electrophotographic image-forming apparatus body according to the embodiment of the present invention.

FIG. 1 is a perspective view of a process cartridge according to the present invention, FIG. 2 is a main sectional view of the process cartridge according to the present invention, and FIG. 3 is a main sectional view of an electrophotographic image-forming apparatus (hereinafter, referred to as an "image-forming apparatus") according to the present invention. One example of the process cartridge of the present invention shown in those drawings is equipped with an image bearing member and process means acting on the image bearing member. Examples of the process means are charging means for charging the surface of the image bearing member, a developing device for forming toner images on the image bearing member, and cleaning means for eliminating toner that remains on the surface of the image bearing member.

As shown in FIG. 2, a process cartridge B is composed of: a photosensitive drum 7; a cleaning unit C composed of a charging roller 8 as charging means and a cleaning blade 10*a* as cleaning means arranged in the surroundings of the photosensitive drum 7, and a cleaning frame member 13 accommodating them therein; and a developing unit D including a developing device composed of a developing roller 9*c* and a developing blade 9*d*, a developing frame member 12 accommodating the developing device therein, and a developer-accommodating frame member (hereinafter, referred to as a "toner frame member") 11 accommodating toner therein.

The process cartridge B further includes side covers 90 and 91 covering a drive gear line (not shown) and so on, on the side surfaces of both or either of the developing frame member 12 and(or) the toner frame member 11 (see FIG. 1).

This process cartridge B is mounted on an image-forming apparatus body A as shown in FIG. 3 and used for forming images. A recording medium 2 is sent out of a paper feed cassette 3*a* arranged in the lower part of the image-forming apparatus by a pickup roller 3*b* and conveyed by a transport roller 3*c*. The recording medium 2 is subsequently allowed to stand by in a registration roller 3*e*. In synchronization with the movement of this recording medium, the photosensitive drum 7 is selectively exposed to light from an aligner 1 to form a latent image. Toner accommodated in the toner frame member 11 is then thin-layered and supported on the surface of a developing roller 9*c* by means of a developing blade 9*d*. A developing bias is applied to the developing roller 9*c*, thereby supplying the toner into the photosensitive drum 7 according to the latent image to form a toner image. In synchronism with the timing when the toner image is formed on the photosensitive drum 7, the recording medium 2 is sent out of the registration roller 3*e* to an opposite portion where a transfer roller 4 and the photosensitive drum 7 are placed opposite from each other. A bias voltage is applied to the transfer roller 4, thereby transferring the toner image on the photosensitive drum 7 onto the recording medium 2 that has been conveyed. Following the transfer, the residual toner on the photosensitive drum 7 is eliminated by the cleaning means 10. Specifically, while the residual toner on the photosensitive drum 7 is scraped off by the cleaning blade 10*a*, the toner that has been scraped off is scooped by a scooping sheet (not shown) and collected into a waste toner reservoir 10*b*. The recording medium 2 onto which the toner image was transferred is conveyed to a fixing device 5 to fix the image. The recording medium 2 is then ejected to a delivery tray 6 in the upper portion of the image-forming apparatus by delivery rollers 3*g*, 3*h*, and 3*i*.

Next, the construction of coupling means, a power transmission mechanism for transmitting driving force from the image-forming apparatus body A to the process cartridge B, will be described.

Figure 5:
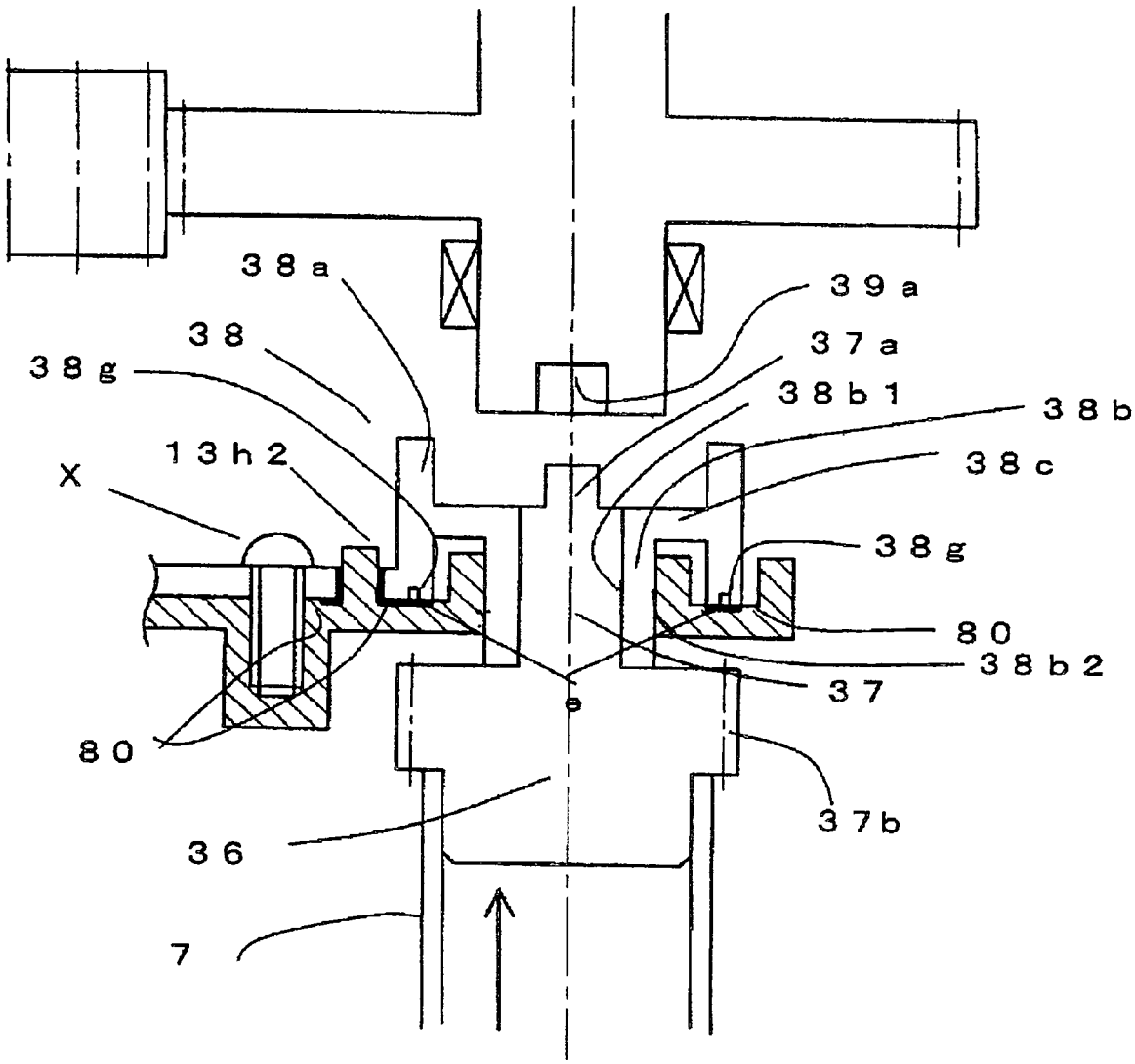
FIG. 5 is a partial vertical sectional view of the process cartridge according to the embodiment of the present invention.

FIG. 5 is a vertical sectional view of a coupling portion for attaching the photosensitive drum 7 to the process cartridge B. The drawing shows that the photosensitive drum 7 is attached to the process cartridge B at one end in the longitudinal direction thereof via a coupling on the drum side and a coupling on the cartridge side.

The coupling on the drum side has a coupling convex shaft 37 (cylindrical shape) provided in a drum flange 36 attached to one end of the photosensitive drum 7. A convex portion 37*a* is formed in the apical surface of the coupling convex shaft 37. In this embodiment, the drum flange 36 is molded integrally with the coupling convex shaft 37 and the convex portion 37*a*. It is noted that the end surface of the convex portion 37*a* is parallel to the end surface of the coupling convex shaft 37. In FIG. 5, the convex portion 37*a* is fitted with a concave portion 39*a* provided in a component nearer a driving force source such as a motor and plays a role in transmitting the driving force to the photosensitive drum 7. The coupling convex shaft 37 is fitted with an inner peripheral portion 38*b*1 of a protrusion 38*a* of a coupling on the cartridge side 38 which will be described below and functions as a drum rotation axis. The drum flange 36 is provided integrally with a helical drum gear 37*b* that meshes with a developing roller gear (not shown) fixed coaxially in the developing roller 9*c* inside the process cartridge B so that the drum gear 37*b* serves as a power transmission component having a function for transmitting driving force.

Figure 4:
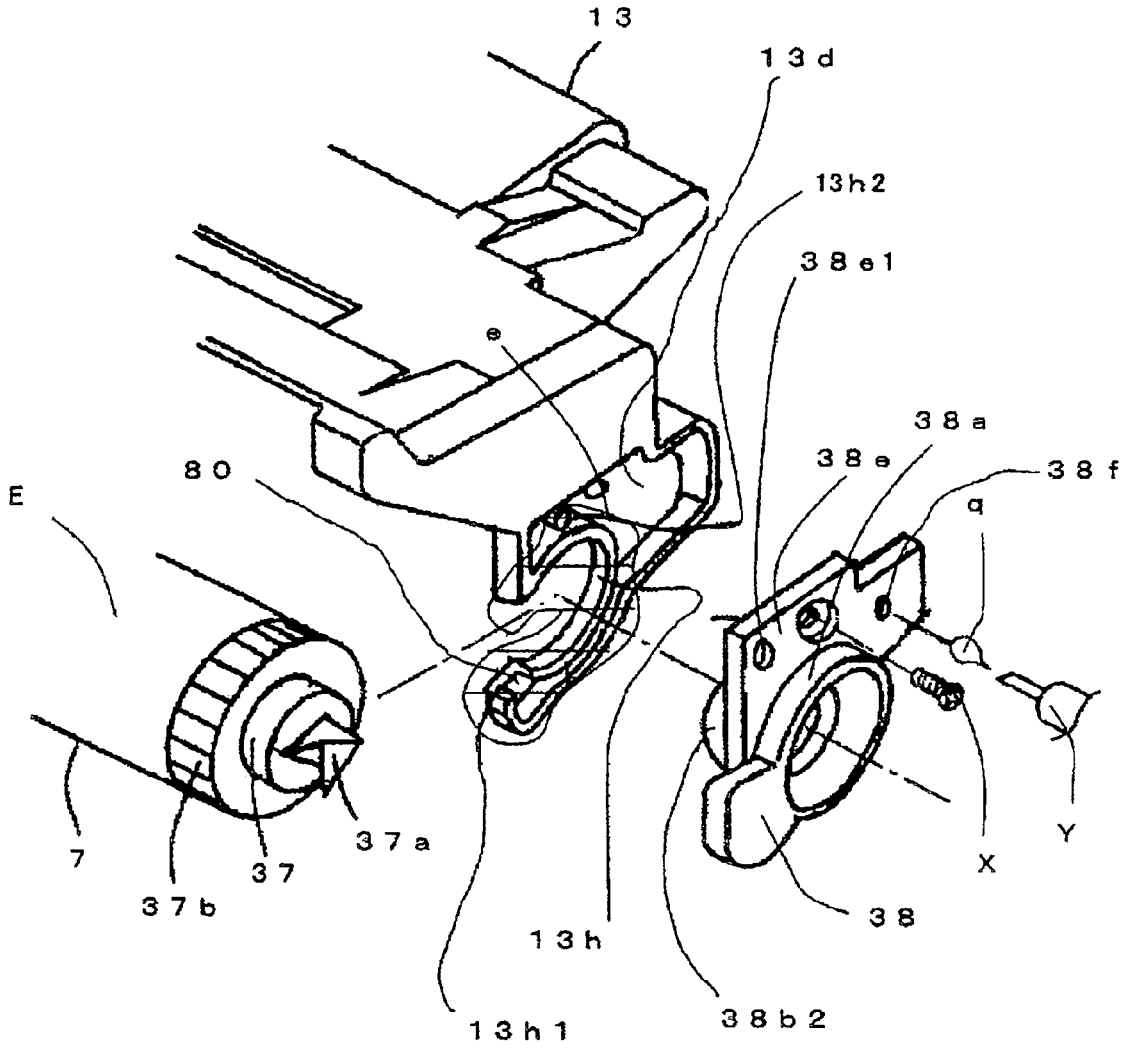
FIG. 4 is a perspective view schematically illustrating partial construction of the process cartridge according to the embodiment of the present invention.

As shown in FIGS. 4 and 5, the coupling on the cartridge side 38 is integrally composed of: the protrusion 38*a* with a large diameter and a tubular shape; a protrusion 38*b* having an outer peripheral portion 38*b*2 with a small diameter that is concentric with the protrusion 38*a*; and a disc portion 38*c* connecting both protrusions together. The direction of the central axis of both protrusions and the disc portion is in agreement with the longitudinal direction of the photosensitive drum. The inner peripheral portion 38*b*1 of the protrusion 38*a* is fitted with the coupling convex shaft 37 of the coupling on the drum side as described above and functions as a bearing for the coupling convex shaft 37. Thus, because the coupling on the cartridge side 38 functions as a bearing for the photosensitive drum, the coupling on the cartridge side 38 is also referred to as a "drum bearing 38".

[Bonding Between Cleaning Frame Member and Drum Bearing]

FIG. 4 is a perspective view specifically showing the relationship of attachment between the drum bearing 38 and the cleaning frame member 13. With reference to this drawing, the attachment of the drum bearing 38 to the cleaning frame member 13 and the attachment of a unitized photosensitive drum unit E to the cleaning frame member 13 will concretely be described.

As shown in FIG. 4, a side wall 13*d* of the cleaning frame member 13 is provided with an attachment hole 13*h* into which the outer peripheral portion 38*b*2 of the small-diameter protrusion 38*b* of the drum bearing 38 is inserted. The attachment hole portion has a segment circle portion 13*h*1 composed of opposed space smaller than the diameter of the attachment hole. This space is larger than the diameter of the coupling convex shaft 37. A positioning pin 13*h*2 formed and provided integrally in the side wall 13*d* of the cleaning frame member 13 is closely fitted with a hole 38*e*1 provided in a flange portion 38*e* of the drum bearing 38. Moreover, the longitudinal position of the drum bearing 38 and the cleaning frame member 13 is determined by an abutment surface (reference) 80.

The above construction allows the unitized photosensitive drum 7 to be attached to the cleaning frame member 13 in the axial direction (i.e., in the longitudinal direction) from the direction that intersects the axial direction and determines the positional relationship of the drum bearing 38 against the cleaning frame member 13 when the drum bearing 38 is attached to the cleaning frame member 13 from the longitudinal direction.

For attaching the unitized photosensitive drum 7 to the cleaning frame member 13, as shown in FIG. 4, the photosensitive drum 7 is moved in the direction that intersects the longitudinal direction. The drum gear 37*b* is allowed to stay within the cleaning frame member 13. The coupling convex shaft 37 is allowed to pass through the segment circle portion 13*h*1 and inserted into the bearing attachment hole 13*h*. In this state of things, the drum bearing 38 is moved in the axial direction so that the coupling convex shaft 37 is inserted into the bearing portion (protrusion) 38*b*. The drum bearing 38 is further moved in the axial direction to allow the bearing portion 38*b* to be fitted with the bearing attachment hole 13*h* of the cleaning frame member 13, which is in turn fastened with screws.

Figure 6:
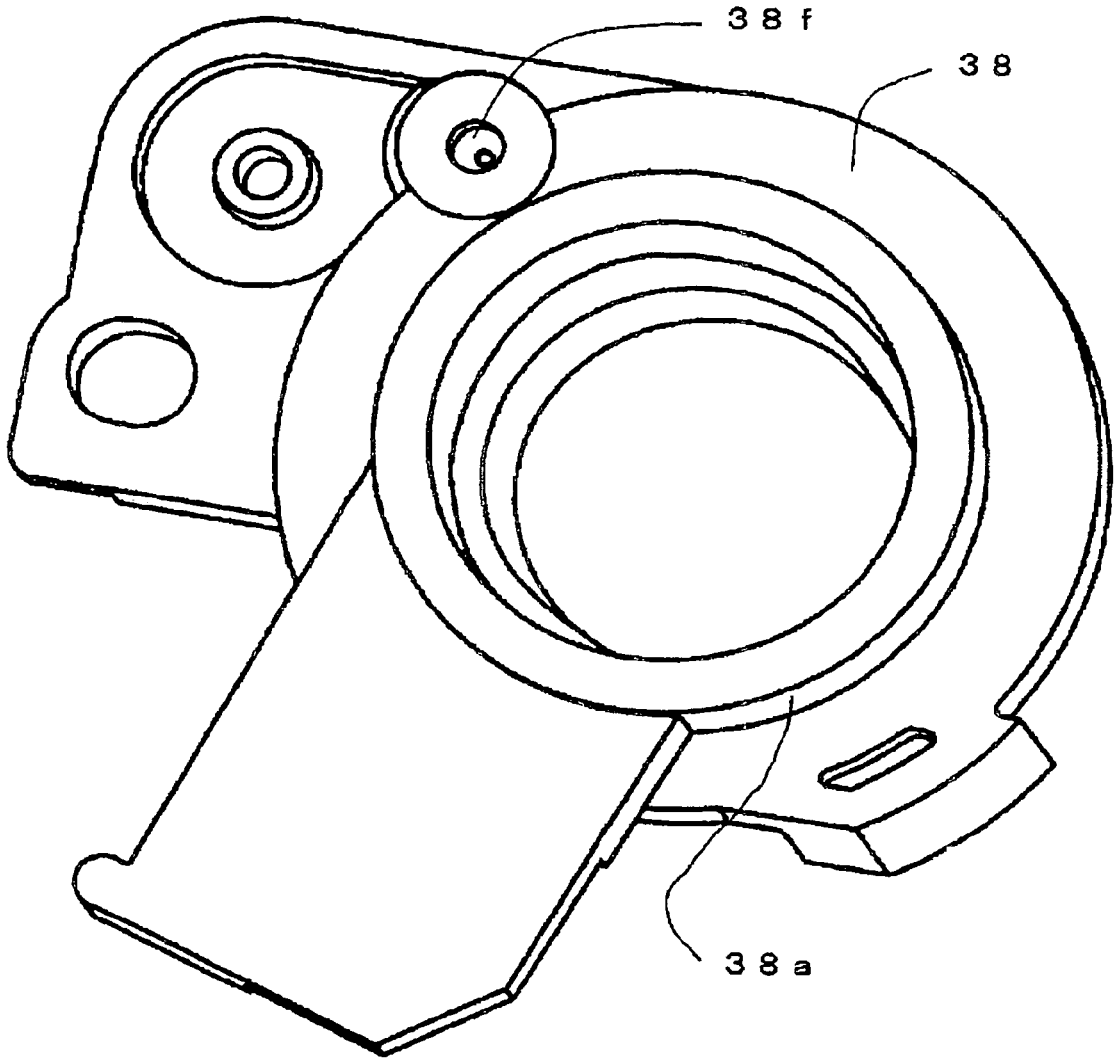
FIG. 6 is an enlarged view of components of the process cartridge according to the embodiment of the present invention.

After the unitized photosensitive drum 7 is fixed in the cleaning frame member 13 by fastening with screws, a terpene solvent q (which will be described below in detail) is supplied to the junction between the cleaning frame member 13 and the drum bearing 38 from a terpene solvent inlet 38*f* formed on the drum bearing 38. The terpene solvent q can be supplied using an injector Y such as a dropper. The supplied solvent passes through a concave portion (slit) 38*g* provided in the back surface of the drum bearing, which communicates with the inlet and forms a flow path for supplying the terpene solvent to surfaces to be bonded. The solvent then spreads across the junction (see FIGS. 6, 7, and 9).

It is preferable to supply the terpene solvent to the junction by a capillary phenomenon. The concave portion 38*g* of a first flow path from the terpene solvent inlet 38*f* to the vicinity of the junction has, preferably, a width of 0.1 to 2 mm and a depth of 0.1 to 2 mm. A flow path formed by the concave portion has, preferably, a cross section of 4 $mm^2$ or smaller. A flow path having a cross section larger than 4 $mm^2$ is less likely to cause a capillary phenomenon and tends to have a difficulty in supplying a terpene solvent to surfaces to be bonded.

Figure 7:
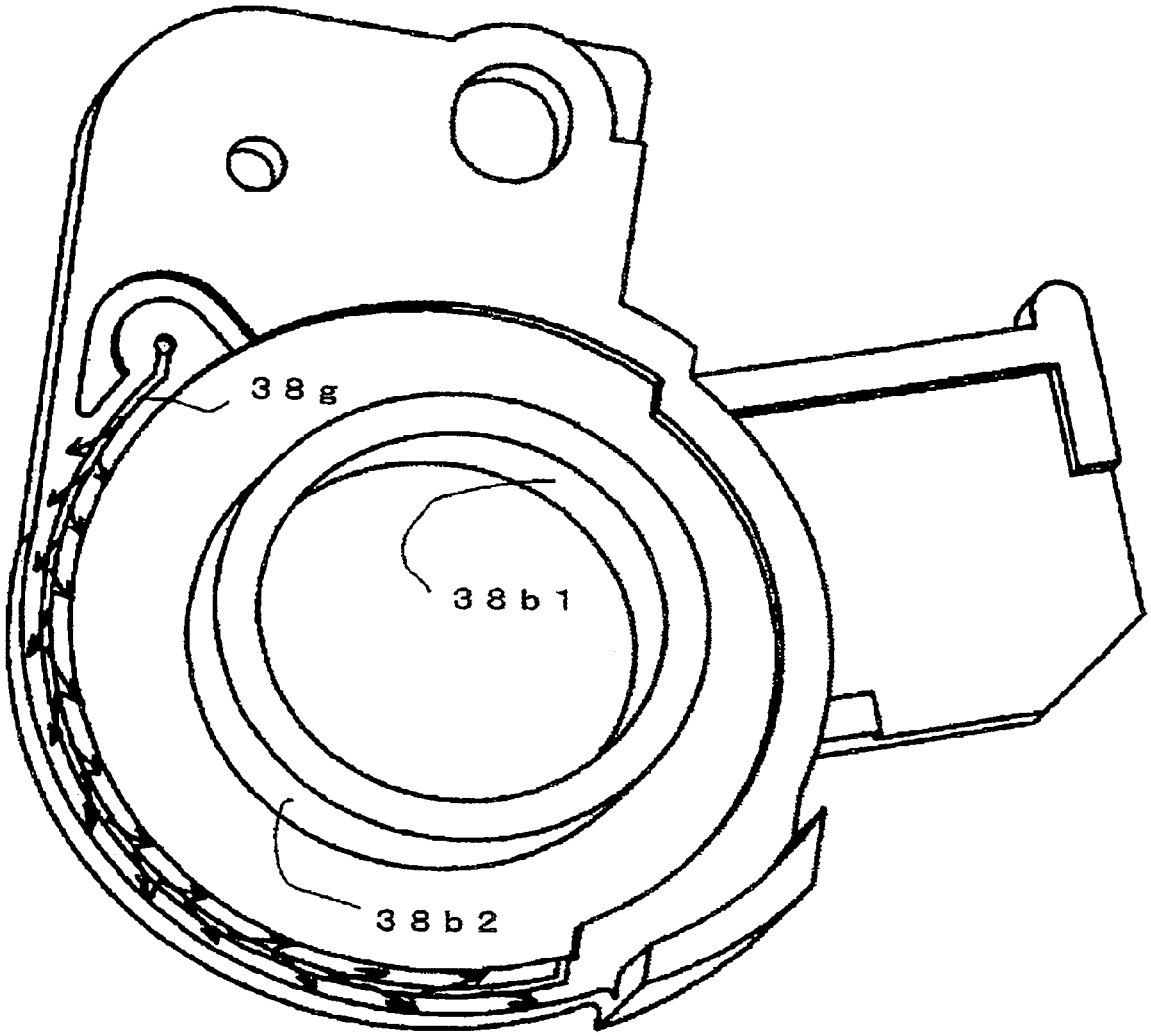
FIG. 7 is an enlarged view of components of the process cartridge according to the embodiment of the present invention.
Figure 9:
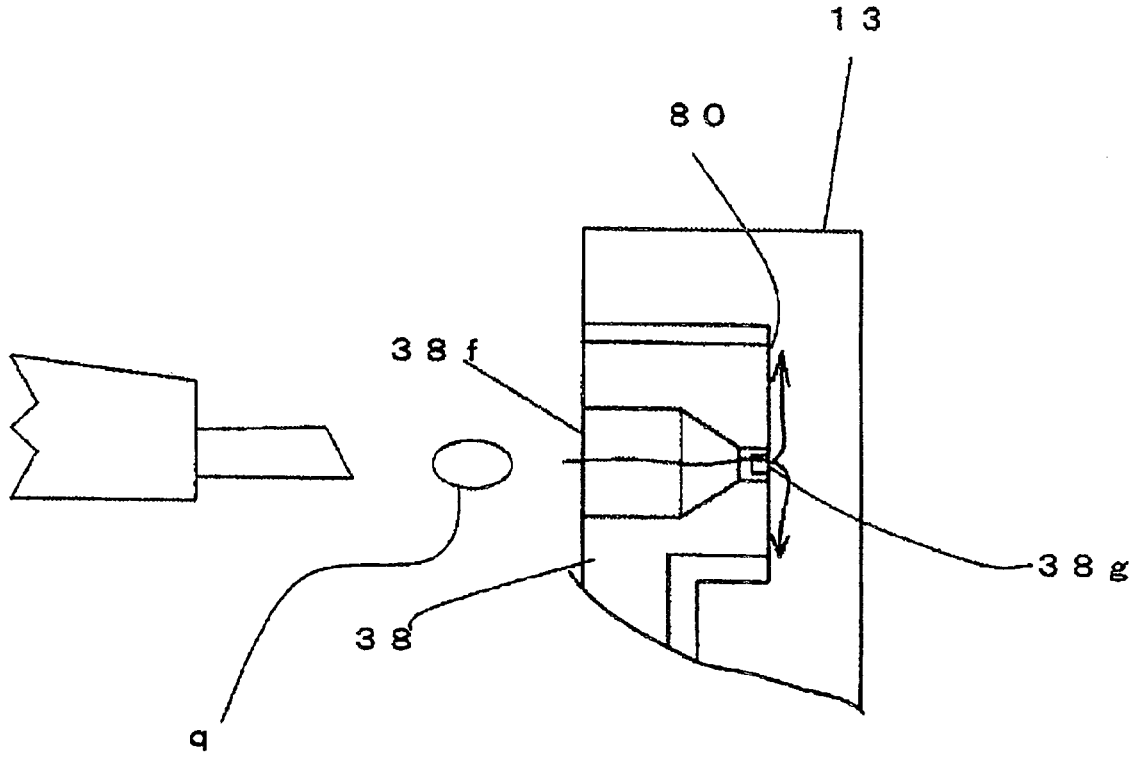
FIG. 9 is a partial vertical sectional view of the process cartridge according to the embodiment of the present invention.

The terpene solvent that was supplied to the vicinity of the junction through the concave portion 38*g* of the first flow path further spreads to a second flow path Z or a small concavoconvex portion M as indicated by Z or M in FIGS. 10 and 11 and subsequently from the flow path to the whole surfaces to be bonded by a capillary phenomenon, and is supplied to the whole surfaces to be bonded (see arrows indicating flows in FIGS. 7 and 9).

Figure 10:
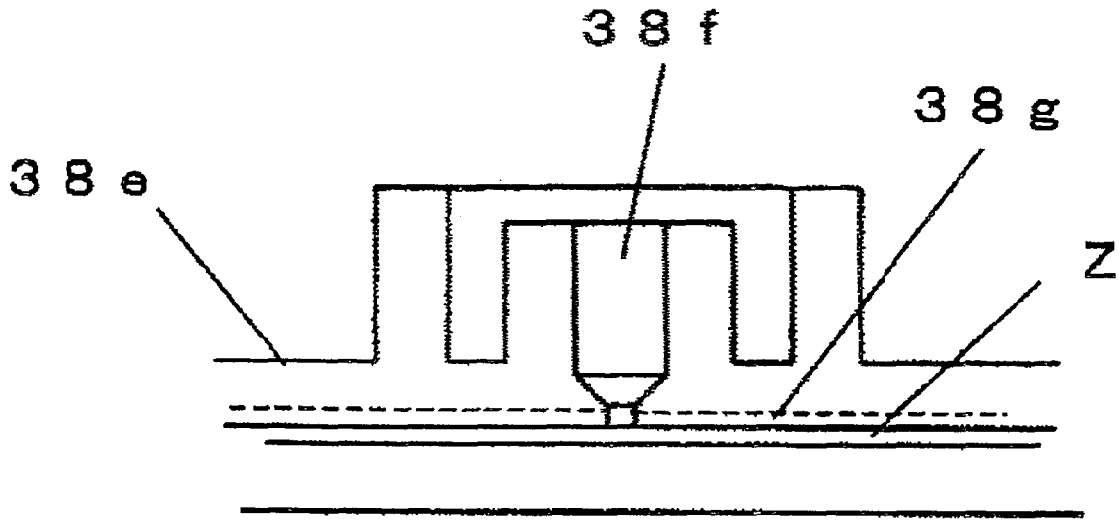
FIG. 10 is a partial vertical sectional view of the process cartridge according to the embodiment of the present invention.
Figure 11:
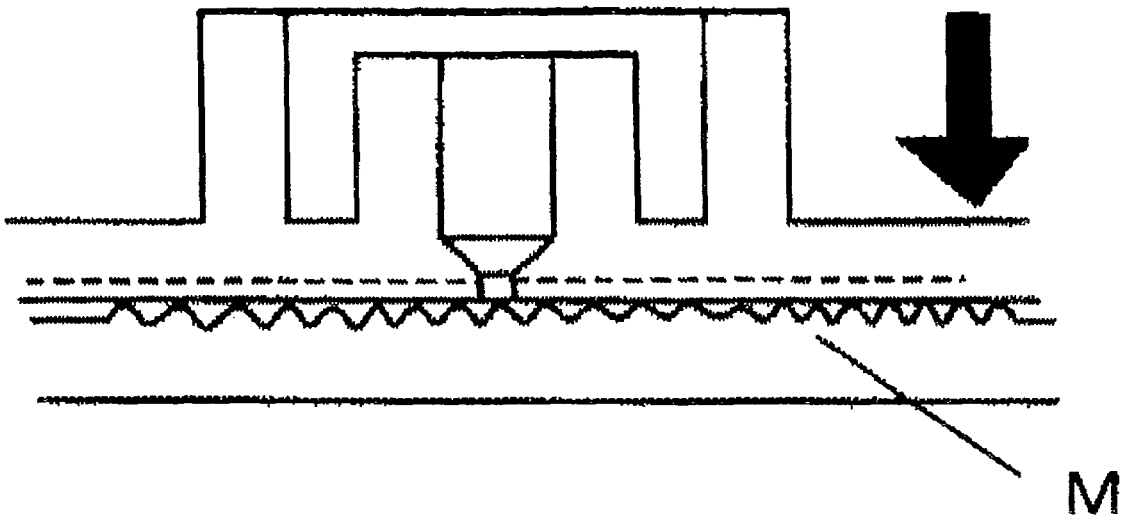
FIG. 11 is a partial vertical sectional view of the process cartridge according to the embodiment of the present invention.

When the terpene solvent that has passed through the first flow path is allowed to spread across the whole surfaces to be bonded via the second flow path, a large gap between components to be bonded as indicated by Z in FIG. 10 makes it difficult to supply the terpene solvent to regions to be bonded e by the use of a capillary phenomenon. On the contrary, if surfaces to be bonded are strongly pressurized with respect to each other and the contact strength is great, a capillary phenomenon is also less likely to occur and the supply of the terpene solvent becomes difficult. Thus, it is preferred that sites to be bonded are in the vicinity of each other or in light contact with each other. In a preferred embodiment, at least one of surfaces to be bonded is provided with small concavoconvex as indicated by M in FIG. 11 to thereby provide space so that the terpene solvent spreads across the contacted portions by a capillary phenomenon. Such concavoconvex is, for example, a, crimp whose depth is preferably 20 to 40 μm on average (Rz). If the depth is larger than 40 μm, the bonding of the valley of the crimp to the counterpart component is insufficient. Therefore, the bonding strength tends to decrease as a whole.

Figure 8:
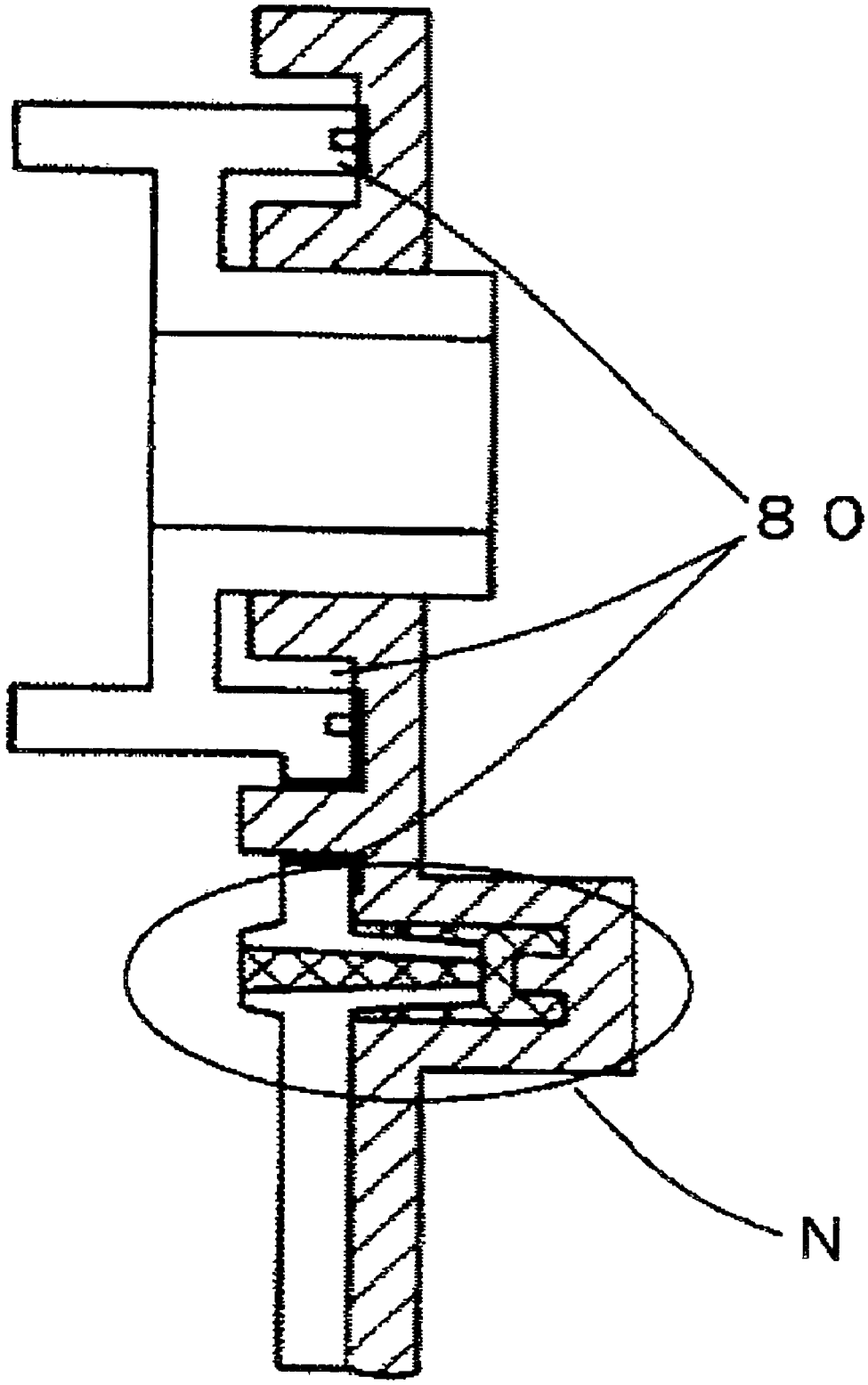
FIG. 8 is a partial vertical sectional view of the process cartridge according to the embodiment of the present invention.

Moreover, when the terpene solvent is used for bonding, it takes a little time to complete the bonding of two components (e.g., when d-limonene is used as a solvent, a few minutes to several dozen minutes are required). Therefore, fastening with screws is performed if necessary and, as shown in FIG. 8, a resin bonding portion N (two components are bonded by injecting a molten resin between them) is provided for bonding. As a result, it is possible to restrain the detachment of both components at the junction before two components are completely bonded by the terpene solvent.

[Bonding Between Toner Frame Member and Side Covers]

Next, the fixation of the toner frame member 11 to the side covers 90 and 91 covering the drive gear line (not shown) and so on and further to a drum-protecting member (drum shutter member) 18 by resin bonding will be described.

Figure 20:
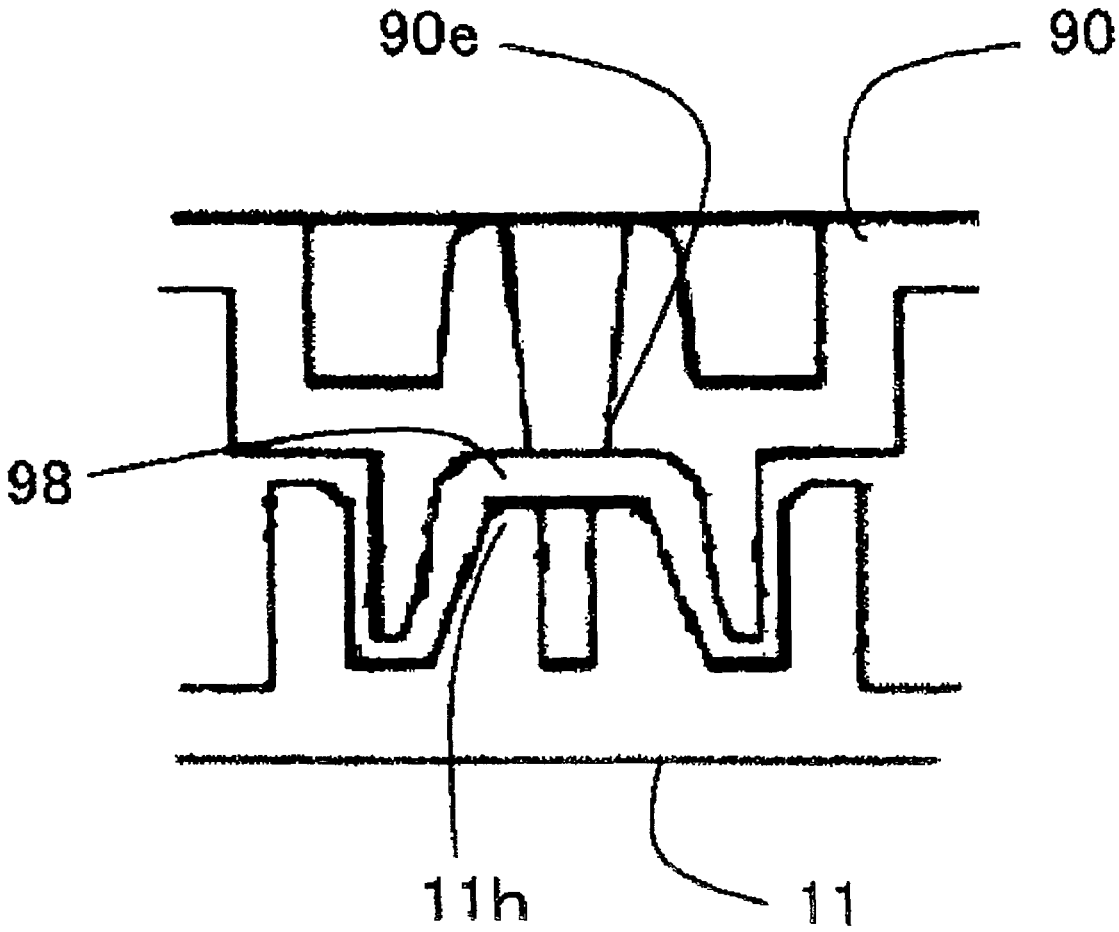
FIG. 20 is a schematic main vertical sectional view of the resin bonding portion of the process cartridge according to the embodiment of the present invention, prior to the injection of a resin.
Figure 21:
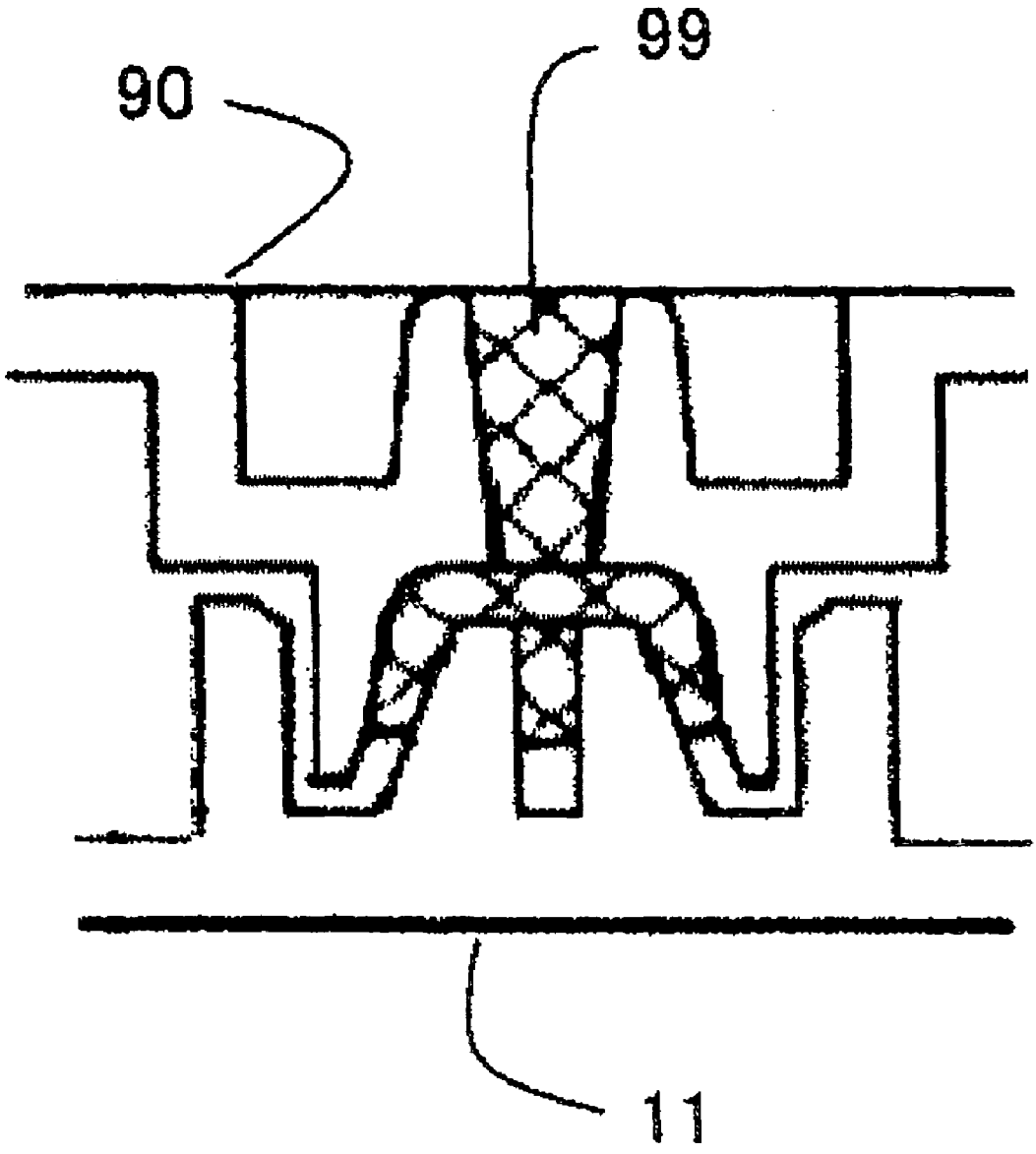
FIG. 21 is a schematic main vertical sectional view of the resin bonding portion of the process cartridge according to the embodiment of the present invention into which a resin has been injected.
Figure 22:
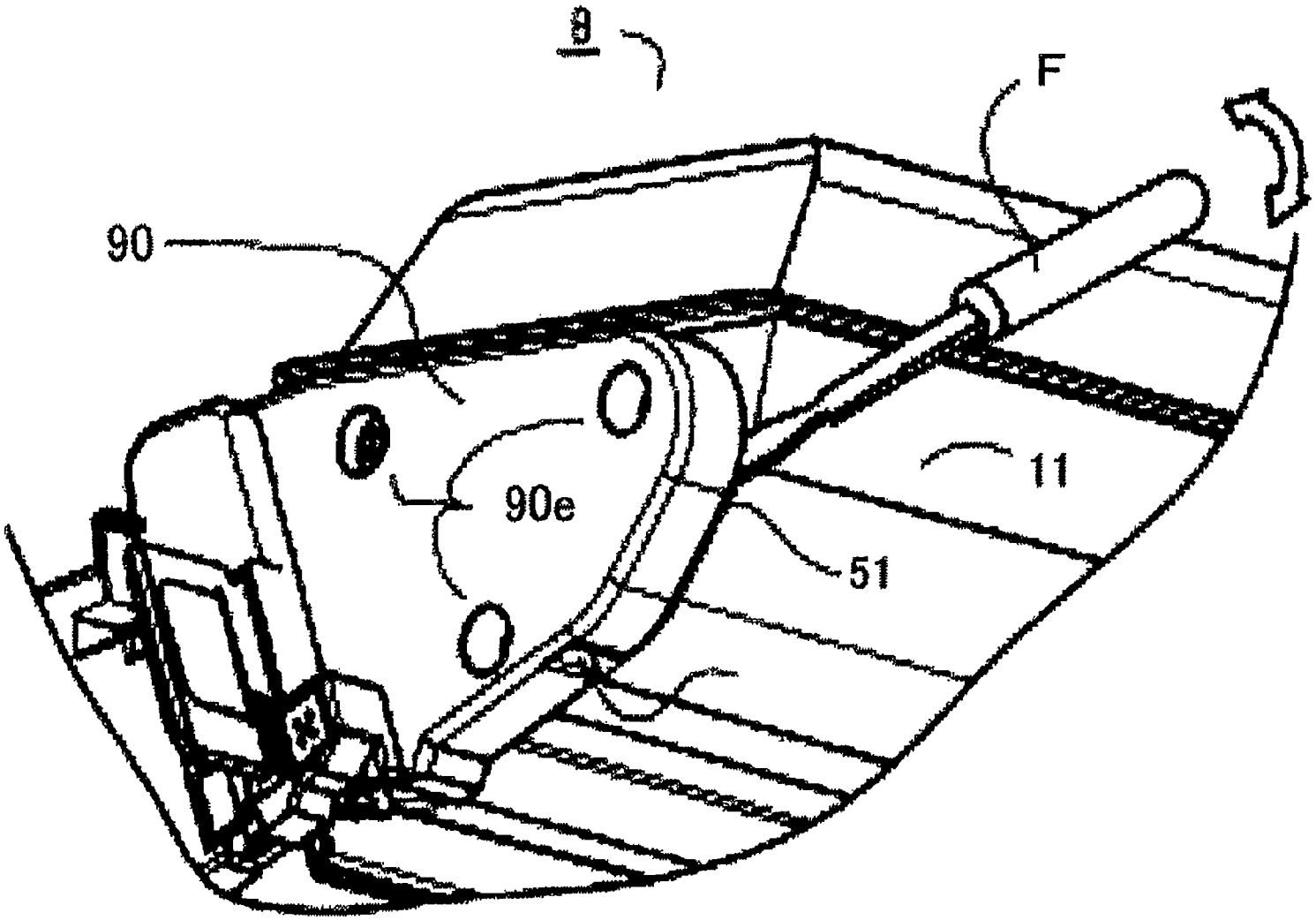
FIG. 22 is a perspective view of the process cartridge according to the embodiment of the present invention in which a simple jig for disassembly (screwdriver) has been set.
Figure 23:
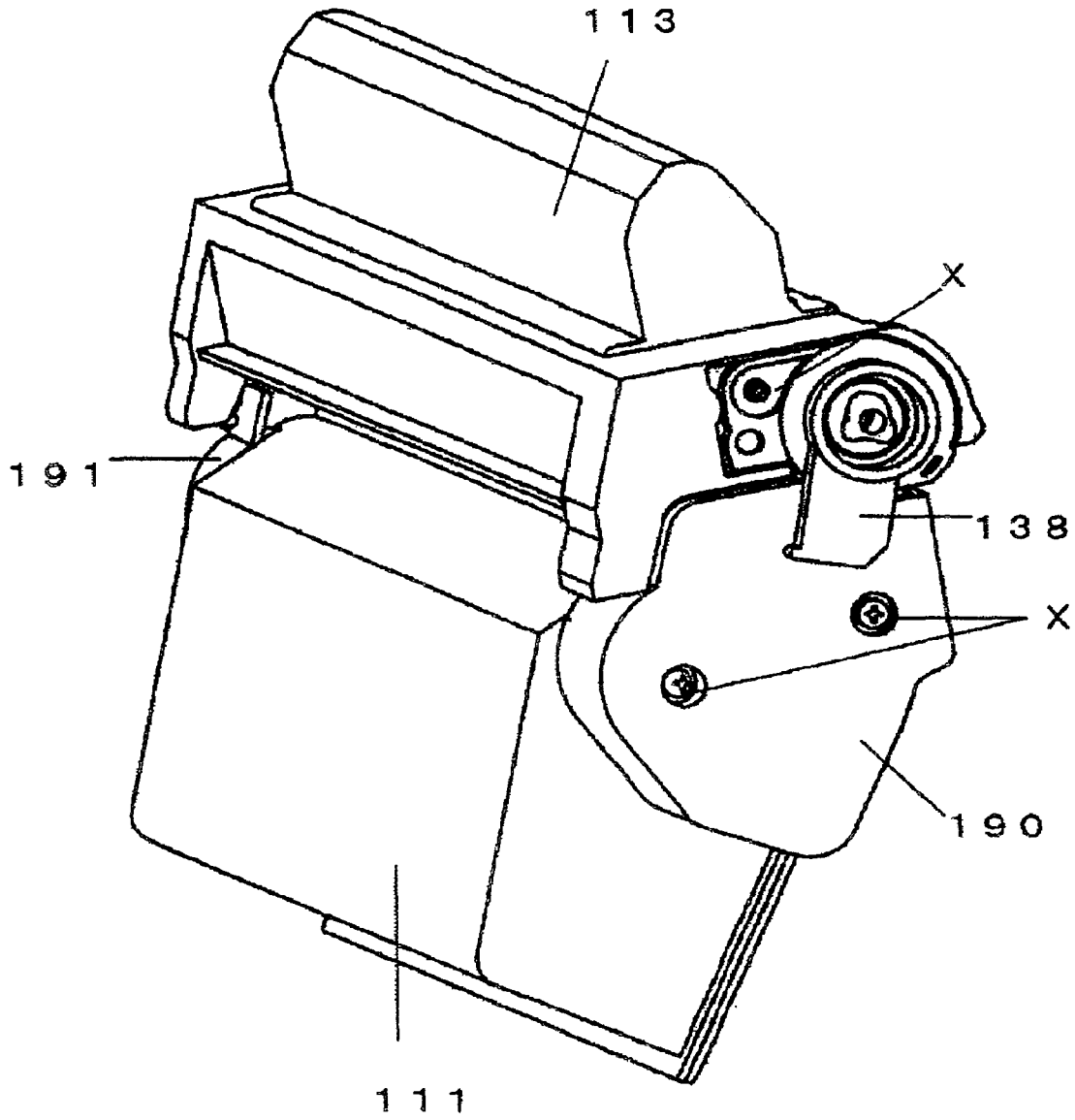
FIG. 23 is a perspective view of a conventional process cartridge.
Figure 24:
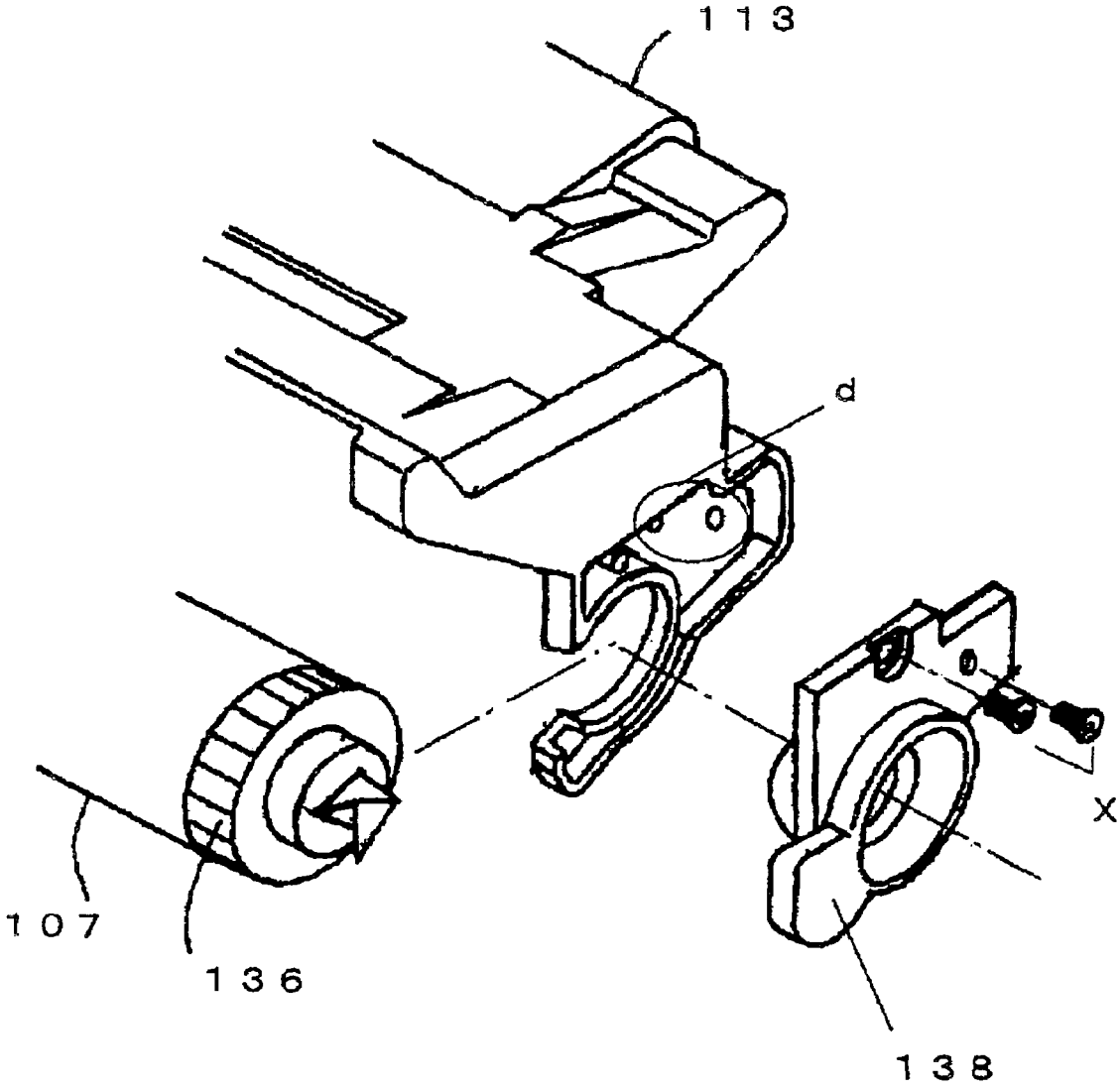
FIG. 24 is a perspective view schematically illustrating partial construction of the conventional process cartridge.

As shown in FIGS. 20, 21, and 22, the toner frame member 11 and the side cover 90 are provided with resin bonding portions 11*h* and 90*e*, respectively, for bonding and fixing each other. As shown in FIG. 21, a molten resin 99 is injected into a gap 98 between the resin bonding portions 90*e* and 11*h* shown in FIG. 20 to thereby fix both resin bonding portions together. The molten resin 99 used is, preferably, any of those having the same material of the toner frame member 11 and the side cover 90, for example, HIPS (high impact polystyrene).

[Method of Disassembling and Remanufacturing Process Cartridge]

A method of disassembling and remanufacturing the process cartridge B according to the present invention will be described hereinafter. At first, the process cartridge B is separated into the cleaning unit C and developing unit D (see FIG. 1).

EXAMPLES

Example 1

Figure 16:
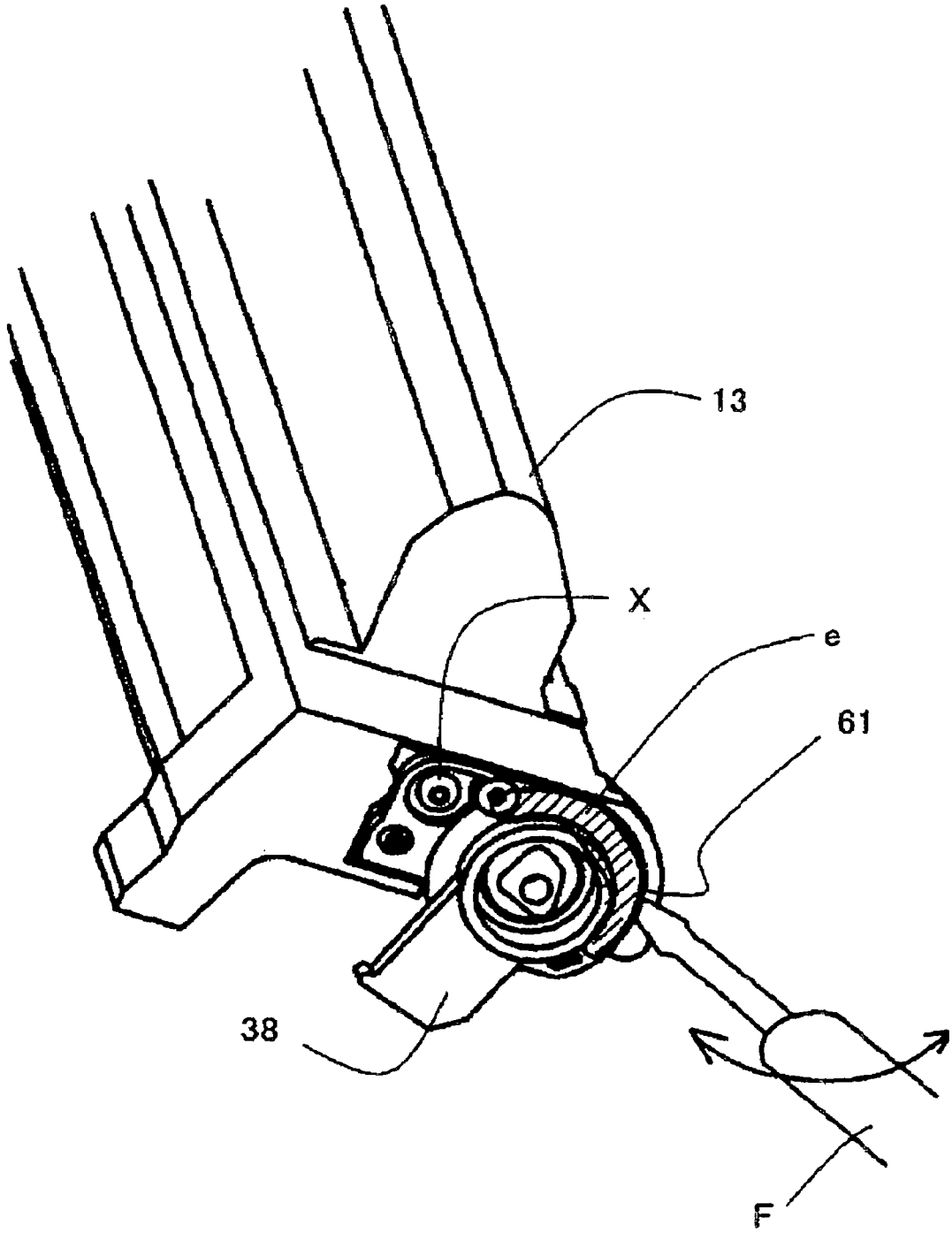
FIG. 16 is a perspective view of the process cartridge according to the embodiment of the present invention in which a simple jig for disassembly (screwdriver) has been set.

Method of Disassembling and Remanufacturing Cleaning Frame Member and Drum Bearing (see FIG. 16)

After the process cartridge B is held, a screw(x) fastening the drum bearing 38 to the cleaning frame member 13 is removed. A simple tool such as a screwdriver F is inserted into a gap 61 in the vicinity of the junction e bonded by the terpene solvent. Using the principle of leverage, the simple tool is moved in the direction of arrows in FIG. 16 to thereby break the junction.

The cleaning frame member 13 and the drum bearing 38 are then separated. Any or all of components supported by each of them are disassembled and inspected. Any or all of reuse, replacement, and repair are performed, followed by rebonding by reapplying a terpene solvent to the separated surfaces of the junction e bonded by the terpene solvent.

Examples of the terpene solvent used in the rebonding (welding) described above include d-limonene, 1-limonene, d1-limonene, d-α-pinene, d-β-pinene, α-terpinene, β-terpinene, γ-terpinene, terpinolene, 2-carene, d-3-carene, 1-3-carene, and phellandrene. Among them, d-limonene, 1-limonene, or d1-limonene is preferably used, with d-limonene being particularly preferred.

Figure 12:
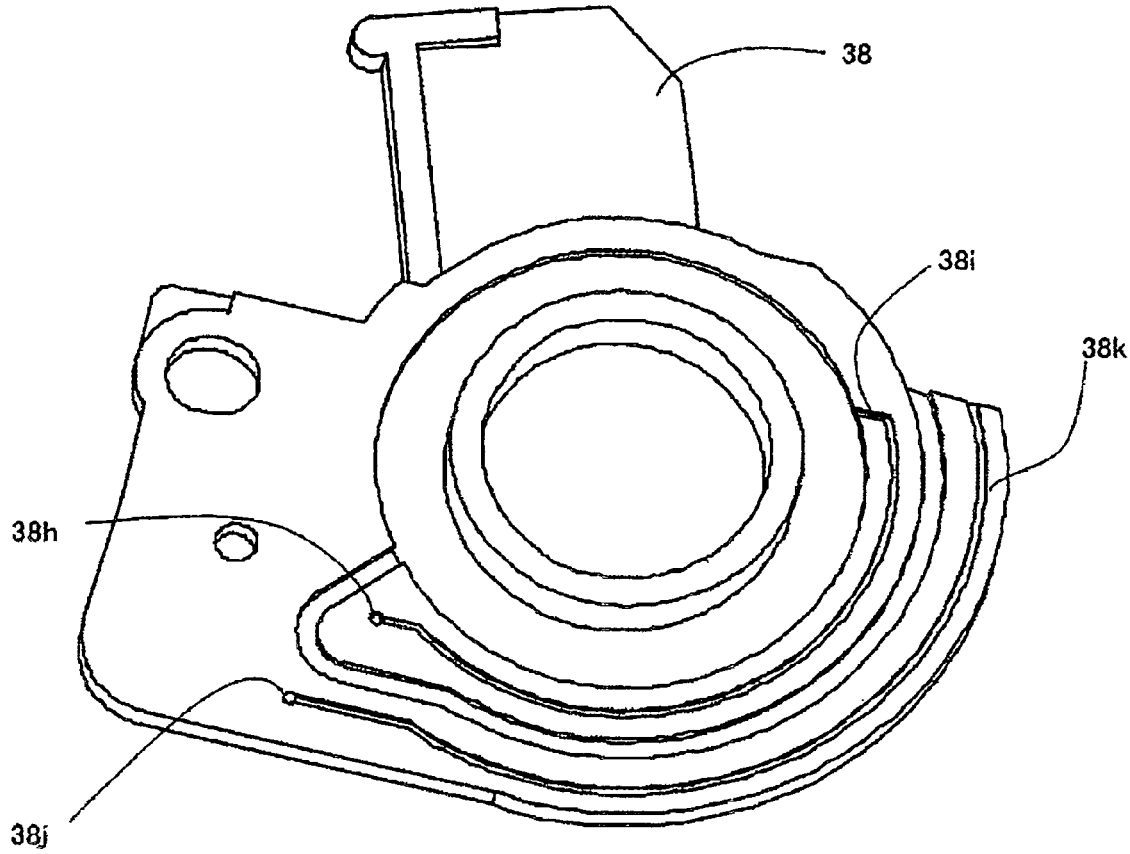
FIG. 12 is an enlarged view of components of the process cartridge according to the embodiment of the present invention.
Figure 13:
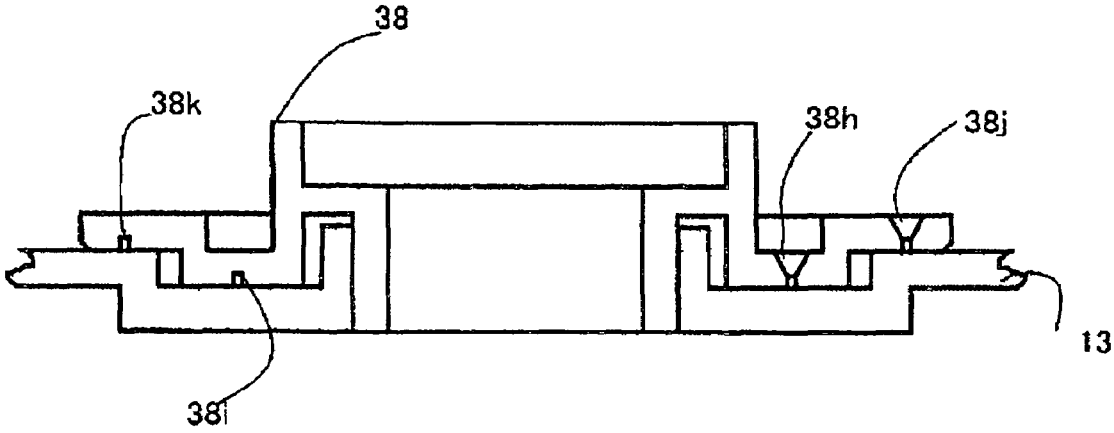
FIG. 13 is a partial vertical sectional view of the process cartridge according to the embodiment of the present invention.

At that time, a capillary phenomenon may be used, similarly with the assembly of a new process cartridge B. Because d-limonene has almost the same viscosity of 0.98 cp at 25° C. as that of water, the supply by a capillary phenomenon involving infiltration into a small space as described above can be performed. However, the surface once utilized for bonding can not be subjected again to the supply of d-limonene by the use of a capillary phenomenon due to the roughness or the like of an inlet, a slit, and bonded surfaces. Therefore, on the assumption that recycling would be performed once, another inlet, slit, and surface to be bonded are provided in advance, as shown in FIGS. 12 and 13. In FIGS. 12 and 13, bonding with limonene using a capillary phenomenon by an inlet 38*h* and a slit 38*i* initially provided inside is carried out. When disassembly and remanufacture are carried out, the components are separated by the method as described above, followed by rebonding by a capillary phenomenon by the use of an inlet 38*j* and a slit 38*k* provided outside.

Figure 14:
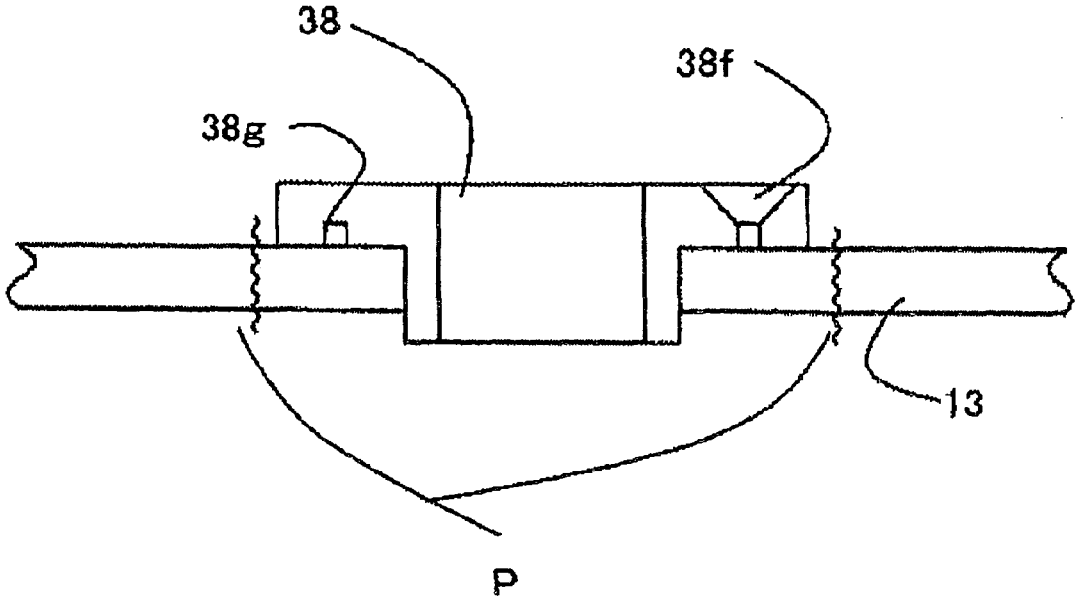
FIG. 14 is a partial vertical sectional view of the process cartridge according to the embodiment of the present invention.
Figure 15:
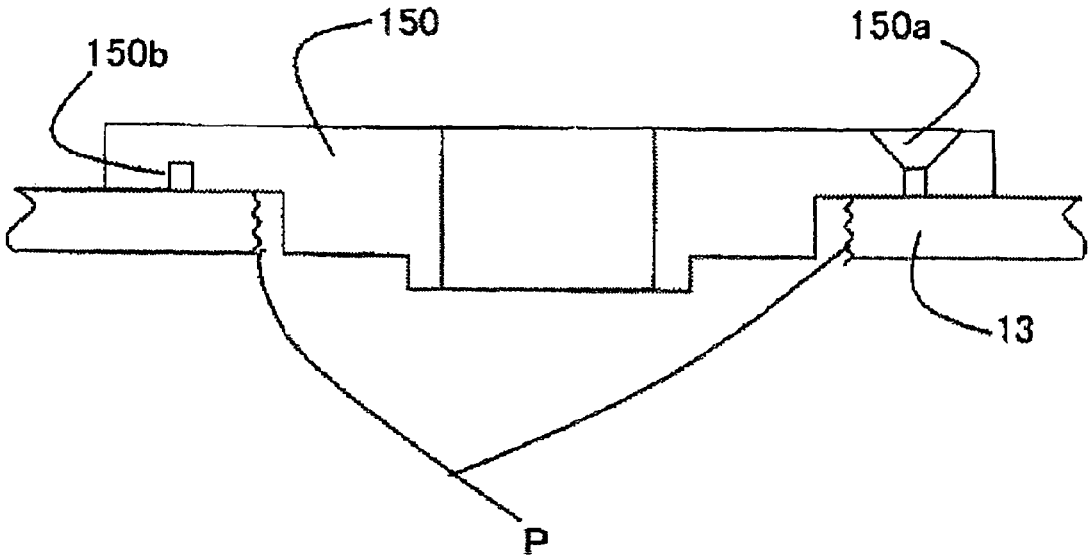
FIG. 15 is a partial vertical sectional view of the process cartridge according to the embodiment of the present invention.

The alternative method of disassembly/bonding will be described with reference to FIGS. 14 and 15. A region in the vicinity of the junction e is cut at the position of, for example, a break line p of the cleaning frame member 13 with a tool such as an ultrasonic cutter (not shown) to separate the cleaning frame member 13 and the drum bearing 38. Rebonding utilizes a new drum bearing (a third component) 150, but no separated drum bearing 38. It is also preferred in this case that a solvent such as d-limonene be supplied using a capillary phenomenon by a inlet 150*a* and a slit 150*b* provided in the new drum bearing 150.

In addition, d-limonene is used as a terpene solvent, and HIPS (those which mixed styrene polymer with 8% by mass of a poly butadiene rubber having an average particle diameter of 0.8 μm) is used as a cleaning frame member 13 and as a drum bearing 38 in the example 1. HIPS is supplemented with 9 parts by mass of a ethylenebis(pentabromobenzene), which is a bromine-based flame retardant, as a first flame retardant, and 2.5 parts by mass of an antimony trioxide as a second flame retardant, with respect to 100 parts by mass of styrene resin.

Furthermore, the cleaning frame member 13 and the drum bearing 38 have flame resistance that meets the UL-94 V2 rank.

Example 2

Method of Disassembling and Remanufacturing Toner Frame Member and Side Cover As shown in FIG. 22, after the process cartridge is held, a simple tool such as the screwdriver F is inserted into a gap 51 in the vicinity of the resin bonding portion between the toner frame member 11 and the side cover 90 and moved in the direction of arrows in the drawing to thereby break the junction by the use of the principle of leverage.

Figure 17:
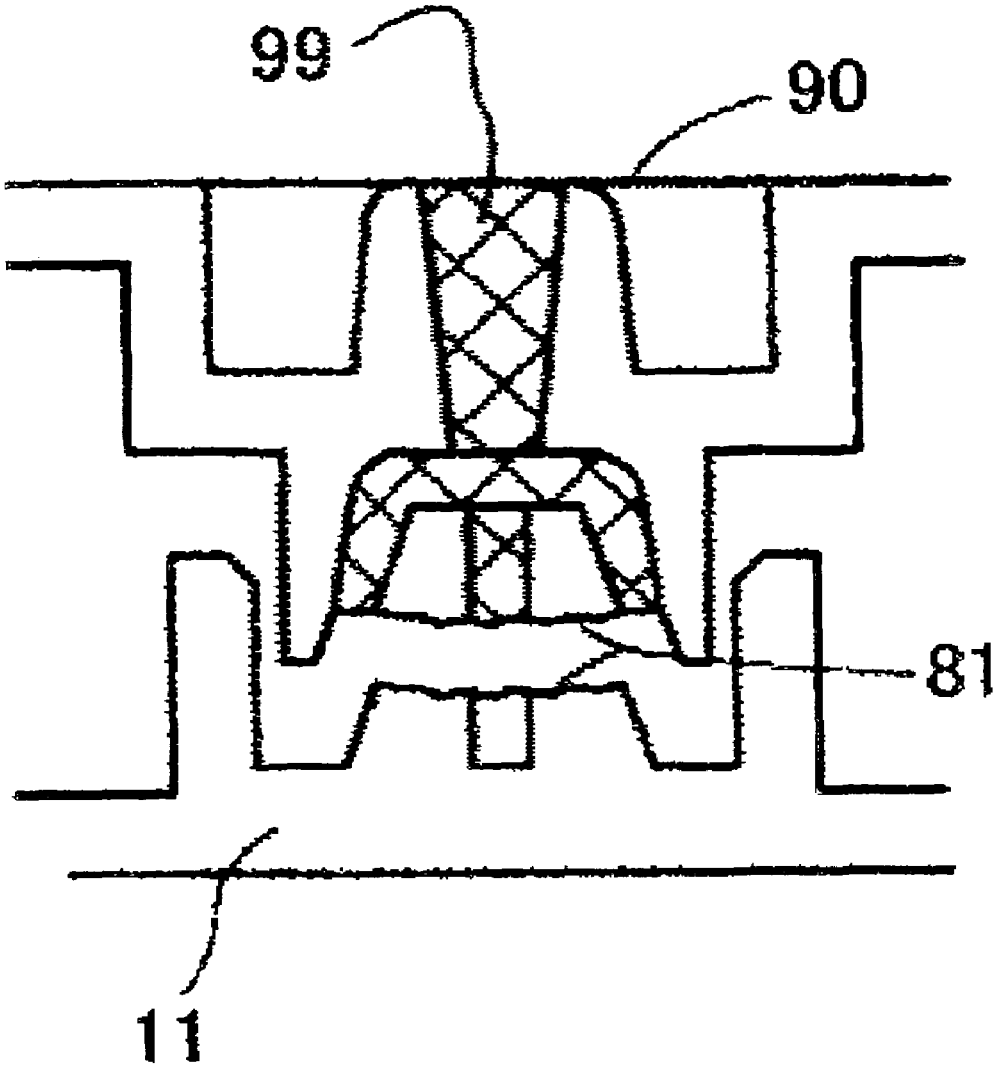
FIG. 17 is a schematic main vertical sectional view of a resin bonding portion of the process cartridge according to the embodiment of the present invention, which shows a separating step in a disassembling and remanufacturing steps thereof.

The toner frame member 11 and the side cover 90 are then separated (see FIG. 17). Any one or all of components supported by each of them are disassembled and inspected. Any one or all of reuse, replacement, repair, and replenishment are performed. Then, d-limonene 88 is applied to separated surfaces thereof 81 (see FIG. 18), followed by the rebonding of the separated surfaces together (see FIG. 19).

Figure 18:
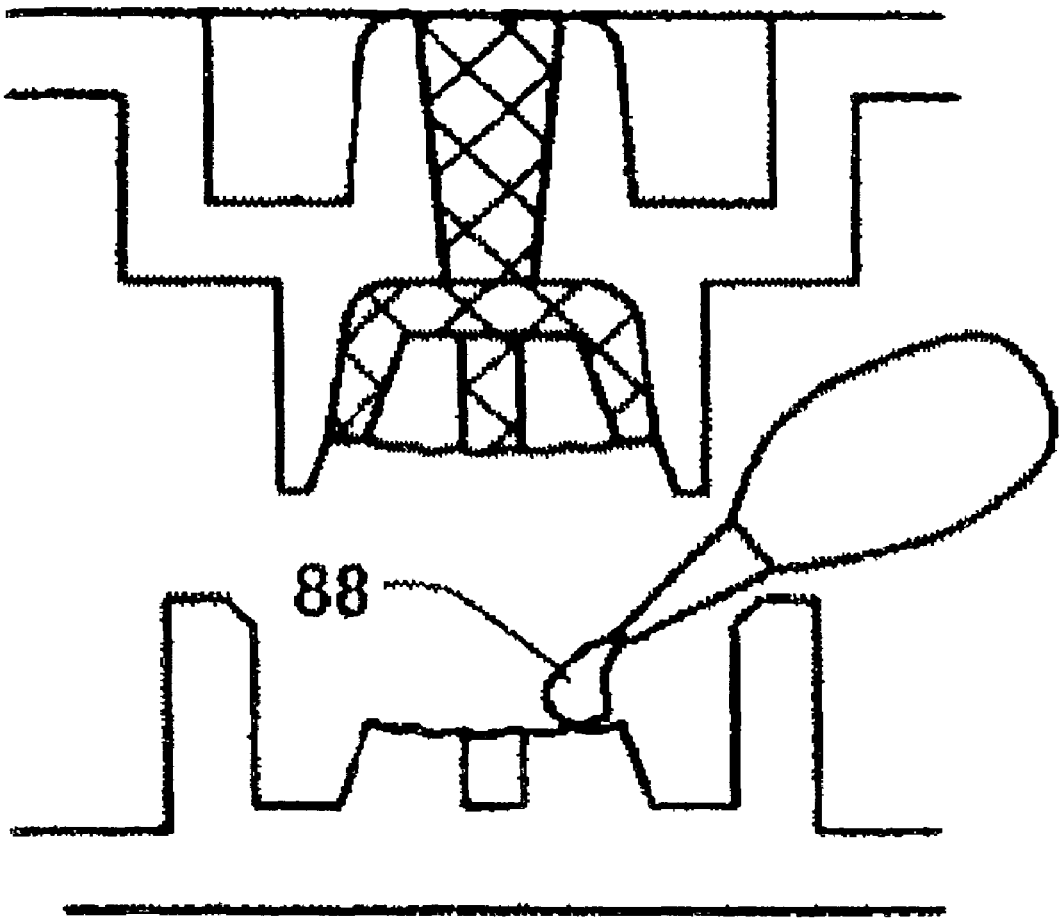
FIG. 18 is a schematic main vertical sectional view of the resin bonding portion of the process cartridge according to the embodiment of the present invention, which shows a solvent-applying step in the disassembling and remanufacturing steps thereof.
Figure 19:
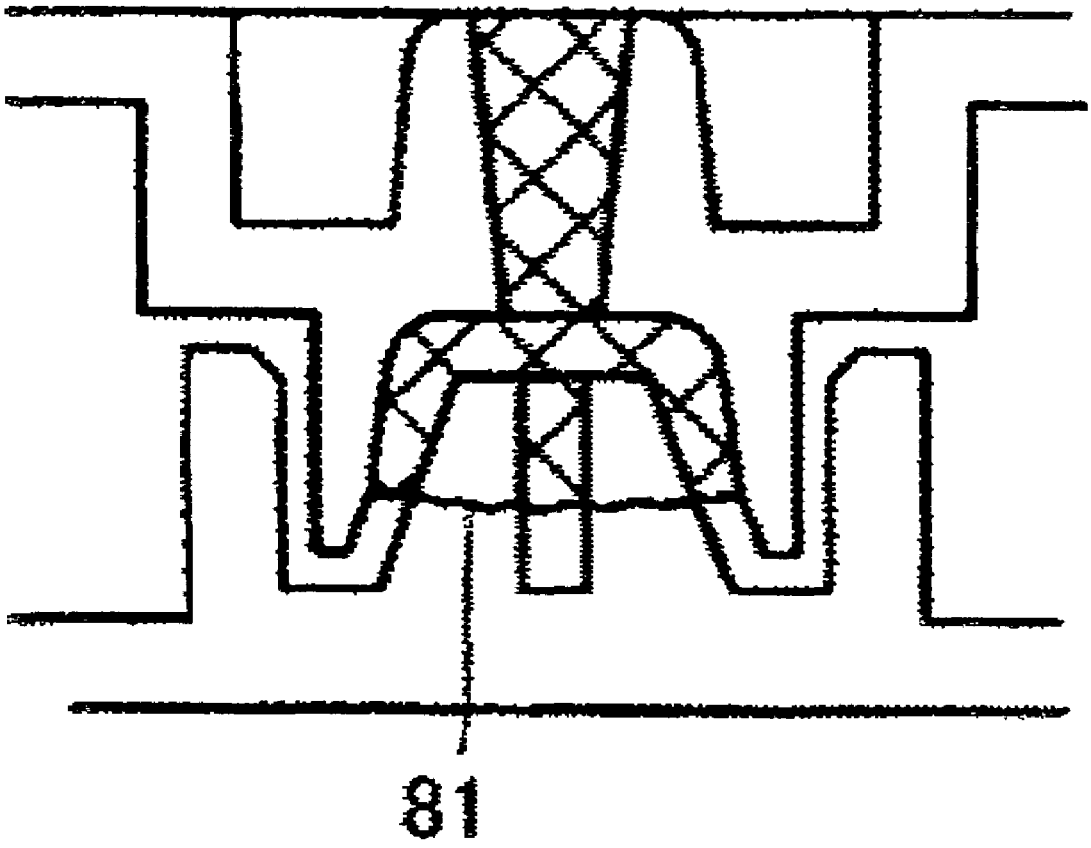
FIG. 19 is a schematic main vertical sectional view of the resin bonding portion of the process cartridge according to the embodiment of the present invention, which shows a bonding step in the remanufacturing step thereof.

Although the toner frame member 11 and the side cover 90 are fixed by resin bonding in FIGS. 18 and 22, the same method of disassembly and remanufacture can also be performed in other fixing means (e.g., ultrasonic welding and thermal caulking).

Thereafter, the cleaning unit C and the developing unit D can be rebonded and used as a recycled cartridge.

The method of producing a recycled cartridge has been described above. For a new cartridge, however, a terpene solvent including d-limonene and other solvents may also be used for separating and rebonding junctions in performing component replacement and assembly readjustment required due to defects in components such as flaws and assembly failures in manufacturing processes in factories.

In the present invention, the terpene solvent (e.g., d-limonene) described above is used in the rebonding (welding) of two components of a cartridge, directing attention to the property of the terpene solvent to dissolve styrene-based resin compositions. Thus, frame members and components to be bonded should be styrene-based resin compositions.

In the present invention, the frame members and the components to be bonded are not particularly limited as long as they are styrene-based resin compositions which are dissolved by terpene solvents. However, the styrene-based resin composition that can preferably be used as the material of a cartridge includes HIPS (high impact polystyrene) that is a rubber-modified styrene-based material. The present material is PS (polystyrene) inexpensive and highly flowable with which a rubber-like polymer or a rubber-like copolymer is mixed for improving impact resistance.

In the present invention, it is preferable to use, as HIPS (high impact polystyrene), any of those mixed with a rubber-like polymer or a rubber-like copolymer having an average particle diameter of 0.5 to 3.0 μm. This is because if the rubber-like polymer or copolymer to be mixed has a smaller average particle diameter, defects in appearance (e.g., scratches) are likely to occur at the time of the molding of the cartridge components described above; whereas if the rubber-like polymer or copolymer has a larger average particle diameter, the weldability of a toner seal member (not shown) tends to be reduced. The rubber-like polymer or copolymer that is preferably used is a polymer selected from the group consisting of polybutadiene, a styrene-butadiene copolymer, polyisoprene, a butadiene-isoprene copolymer, natural rubber, and an ethylene-propylene copolymer.

The materials of the frame members described above are required to have flame resistance that satisfies the UL-94 V2 standard for safety against fire. Therefore, the styrene-based resin composition is supplemented with a bromine-based flame retardant (e.g., ethylenebis (pentabromobenzene), tetrabromobisphenol A derivatives, and polyhalogenated aliphatic ether derivatives) as a first flame retardant or a phosphate-based flame retardant (e.g., resorcinol bis(diphenyl phosphate), bisphenol A bis(diphenyl phosphate)). Further, the addition of a second flame retardant allows reduction in the amount of the first flame retardant added and also allows the prevention of reduction in the physical properties of the styrene-based resin composition as a base polymer.

A concrete example of the second flame retardant that is used is antimony trioxide for a bromine-based flame retardant because antimony trioxide is most highly effective. For a phosphate-based flame retardant, a PPE (polyphenylene ether) resin is used instead of the flame retardant to improve flame resistance.

In addition, d-limonene is used as a terpene solvent, and HIPS (those which mixed styrene polymer with 8% by mass of a polybutadiene rubber having an average particle diameter of 0.8 μm) is used as a toner frame member and as a side cover in the example 2. HIPS is supplemented with 7 parts by mass of a resorcinol bis (diphenyl phosphate), which is a phosphate-based flame retardant, as a first flame retardant, and 10 parts by mass of a PPE (polyphenylene ether) resin, with respect to 100 parts by mass of styrene resin.

Furthermore, the toner frame member and the side cover have flame resistance that satisfies the UL-94 V2 standard.

The present remanufactured cartridge is composed of the styrene-based resin compositions as described above.

This application claims the right of priority under 35 U.S.C. §119 based on Japanese Patent Application No. JP 2004-175099 filed Jun. 14, 2004 which is hereby incorporated by reference herein in their entirety as if fully set forth herein.

What is claimed is:

1. A method of remanufacturing a cartridge detachably mountable in an electrophotographic image-forming apparatus body and composed of styrene-based resin compositions at least in part, comprising the steps of:

(1) dividing the cartridge into at least two divided parts; and (2) bonding at least one of the divided parts with another one of the divided parts and/or a component other than the divided parts by use of a terpene solvent;

wherein, the cartridge is divided at a portion which is bonded by supplying the terpene solvent from a predefined flow path to portions of the cartridge to be bonded by use of a capillary phenomenon, and wherein the cartridge is rebonded by supplying the terpene solvent from another flowpath different from a path flow used in an initial bonding to new portions of the cartridge to be bonded by use of the capillary phenomenon.

2. A method of remanufacturing a cartridge according to claim 1, wherein said step of dividing the cartridge comprises the step of dividing the cartridge in a portion comprising the styrene-based resin compositions.

3. A method of remanufacturing a cartridge according to claim 2, wherein at least one of the styrene-based resin compositions comprises a rubber-modified styrene-based resin and a flame retardant.

4. A method of remanufacturing a cartridge according to claim 1, wherein the terpene solvent comprises d-limonene.

5. A method of remanufacturing cartridge according to claim 2, wherein at least one of the styrene-based resin compositions comprises a mixture of a styrene-based resin and a rubber-like polymer.

6. A method of remanufacturing a cartridge according to claim 5, wherein the rubber-like polymer comprises a rubber-like homopolymer.

7. A method of remanufacturing a cartridge according to claim 6, wherein the rubber-like homopolymer comprises a polymer selected from the group consisting of polybutadiene, polyisoprene, and natural rubber.

8. A method of remanufacturing a cartridge according to claim 5, wherein the rubber-like polymer comprises a rubber-like copolymer.

9. A method of remanufacturing a cartridge according to claim 8, wherein the rubber-like copolymer comprises a copolymer selected from the group consisting of a styrene-butadiene copolymer, a butadiene-isoprene copolymer, and an ethylene-propylene copolymer.

10. A method of remanufacturing a cartridge according to claim 5, wherein the rubber-like polymer comprises a particle having an average particle diameter of 0.5 to 3.0 m.

11. A method of remanufacturing a cartridge according to claim 1, wherein at least one of parts and of components to be bonded together is provided with one of a concave portion, a slit, and a chamfered portion which communicates with an inlet for injecting the terpene solvent and forms a flow path for supplying the terpene solvent to sites to be bonded.

12. A method of remanufacturing a cartridge according to claim 11, wherein the flow path has a cross sectional area of 0.01 to 4.0 $mm^2$.

13. A method of remanufacturing a cartridge according to claim 1, further comprising the step of cleaning surfaces to be bonded before the terpene solvent is applied.

14. A remanufactured cartridge which is remanufactured by using the method of remanufacturing a cartridge according to claim 1.

* * * * *

UNITED STATES PATENT AND TRADEMARK OFFICE

CERTIFICATE OF CORRECTION

PATENT NO. : 7,366,439 B2
APPLICATION NO. : 11/150114
DATED : April 29, 2008
INVENTOR(S) : Osamu Anan et al.

It is certified that error appears in the above-identified patent and that said Letters Patent is hereby corrected as shown below:

COLUMN 3
Line 13, “in-a” should read --in a--.
Line 47, “are” should read --a--.

COLUMN 6
Line 19, before “Next,” --[Power Transmission Mechanism of Photosensitive Drum]-- should be inserted, and “Next,” should begin a new paragraph.

COLUMN 8
Line 25, “small” should read --a small--.
Line 28, “a,” should read --a--.

COLUMN 10
Line 52, “(polystyrene)” should read --(polysterene),-- and “flowable” should read --flowable,--.
Line 53, “with” should read --and with--.

COLUMN 11
Line 49, “solvent;” should read --solvent,--.

COLUMN 12
Line 36, “m” should read --μm--.

Signed and Sealed this

Tenth Day of February, 2009

JOHN DOLL
*Acting Director of the United States Patent and Trademark Office*